US005940068A

United States Patent [19]

Hasegawa et al.

[11] Patent Number: 5,940,068

[45] **Date of Patent: *Aug. 17, 1999**

[54] DISPLAY CONTROLLING APPARATUS AND CONTROL METHOD THEREOF

[75] Inventors: Yoshihiko Hasegawa, Toyonaka; Takashi Yamatani, Suita, both of Japan

[73] Assignee: SNK Corporation, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,950

[22] Filed: Feb. 14, 1996

[30] Foreign Application Priority Data

Feb. 14, 1995 [JP] Japan ..... 7-025115
Apr. 12, 1995 [JP] Japan ..... 7-315075

[51] Int. Cl.[6] ..... G09G 5/00

[52] U.S. Cl. ..... 345/203; 345/192; 345/950

[58] Field of Search ..... 345/24, 113, 114, 345/115, 116, 141, 192, 193, 194, 195, 950, 203; 348/586, 589

[56] References Cited

U.S. PATENT DOCUMENTS 3,351,929 11/1967 Wagner ..... 340/324
4,445,114 4/1984 Stubben ..... 340/726
5,315,692 5/1994 Hanset et al. ..... 395/950
5,411,272 5/1995 Naka et al. ..... 345/122
5,519,825 5/1996 Naughton et al. ..... 395/950
5,544,295 8/1996 Capps ..... 395/950
5,546,518 8/1996 Blossom et al. ..... 395/950
5,552,804 9/1996 Leach ..... 345/114
5,634,850 6/1997 Kitahara et al. ..... 345/115

FOREIGN PATENT DOCUMENTS 6-83320 3/1994 Japan .

*Primary Examiner*—Richard A. Hjerpe
*Assistant Examiner*—Ricardo Osorio
*Attorney, Agent, or Firm*—Merchant & Gould, P.C.

[57] ABSTRACT

The character numbers of the characters of line sprites and the color palette numbers are specified in the regions $C_{1,0}$, $C_{1,1}$ $C_{1,2}$, . . . $C_{1,31}$. The data for specifying display position of the lines and shrinkage are stored in the regions $L_1$, $L_2$ . . . to $L_{380}$. also, the number of active characters to be displayed on the display screen is specified in the region $L_1$, $L_2$, . . . to $L_{380}$. Since only one display position is specified to each of the line sprites, capacity of the memory can be decreased, and control of the display can be done easily. Also, since the number of active characters can be specified in line sprite units, operation for changing the display and other operations can be executed easily with sufficient flexibility.

7 Claims, 36 Drawing Sheets

| LINE NUMBER | INDIVIDUAL CHARACTER DATA | | | | | | | | LINE DATA |
|---|---|---|---|---|---|---|---|---|---|
| 1 | C1,0 | C1,1 | C1,2 | C1,3 | · · · · · | C1,29 | C1,30 | C1,31 | L1 |
| 2 | C2,0 | C2,1 | C2,2 | C2,3 | · · · · · | C2,29 | C2,30 | C2,31 | L2 |
| 3 | | | | | | | | | |
| 4 | | | | | | | | | |
| 5 | | | | | | | | | |
| ⋮ | | | | | | | | | |
| 379 | | | | | | | | | |
| 380 | C380,0 | C380,1 | C380,2 | C380,3 | · · · · · | C380,29 | C380,30 | C380,31 | L380 |

FIG.5

| LINE NUMBER | INDIVIDUAL CHARACTER DATA | | | | | | | | LINE DATA |
|---|---|---|---|---|---|---|---|---|---|
| 1 | $C_{1,0}$ | $C_{1,1}$ | $C_{1,2}$ | $C_{1,3}$ | · · · · · | $C_{1,29}$ | $C_{1,30}$ | $C_{1,31}$ | $L_1$ |
| 2 | $C_{2,0}$ | $C_{2,1}$ | $C_{2,2}$ | $C_{2,3}$ | · · · · · | $C_{2,29}$ | $C_{2,30}$ | $C_{2,31}$ | $L_2$ |
| 3 | | | | | | | | | |
| 4 | | | | | | | | | |
| 5 | | | | | | | | | |
| ⋮ | | | | | | | | | |
| 379 | | | | | | | | | |
| 380 | $C_{380,0}$ | $C_{380,1}$ | $C_{380,2}$ | $C_{380,3}$ | · · · · · | $C_{380,29}$ | $C_{380,30}$ | $C_{380,31}$ | $L_{380}$ |

FIG.17

| LINE NUMBER | LINE DATA | | | | | |
|---|---|---|---|---|---|---|
| | SHRINKAGE IN HORIZONTAL DIRECTION | SHRINKAGE IN VERTICAL DIRECTION | VERTICAL POSITION | CHAIN BIT | ACTIVE CHARACTER NUMBER | HORIZONTAL POSITION |
| 1 | NONE | NONE | 0 | 0 | 32 | 0 |
| 2 | 〃 | 〃 | — | 1 | 32 | — |
| 3 | 〃 | 〃 | — | 1 | 32 | — |
| 4 | 〃 | 〃 | — | 1 | 32 | — |
| ⋮ | ⋮ | ⋮ | ⋮ | ⋮ | ⋮ | ⋮ |
| 29 | 〃 | 〃 | — | 1 | 32 | — |
| 30 | 〃 | 〃 | 0 | 0 | 0 | 0 |
| 31 | 〃 | 〃 | 35 | 0 | 1 | 66 |
| 32 | 〃 | 〃 | 26 | 0 | 2 | 26 |
| ⋮ | ⋮ | ⋮ | ⋮ | ⋮ | ⋮ | ⋮ |

FIG.19 A

| STORING SEGMENT | 0 | 1 | --- | 15 | 16 | --- | 25 | 26 | --- | 31 | 32 | --- | 41 | 42 | --- | 47 | 48 | --- | 463 |
|---|---|---|---|---|---|---|---|---|---|---|---|---|---|---|---|---|---|---|---|
| LINE SPRITE NUMBER | 1 | 1 | --- | 1 | 2 | --- | 2 | 2 | --- | 2 | 3 | --- | 3 | 3 | --- | 3 | 4 | --- | 29 |

FIG.19 B

| STORING SEGMENT | 0 | 1 | --- | 15 | 16 | --- | 25 | 26 | --- | 31 | 32 | --- | 41 | 42 | --- | 47 | 48 | --- | 463 |
|---|---|---|---|---|---|---|---|---|---|---|---|---|---|---|---|---|---|---|---|
| LINE SPRITE NUMBER | 1 | 1 | --- | 1 | 2 | --- | 2 | 32 | --- | 32 | 32 | --- | 32 | 3 | --- | 3 | 4 | --- | 29 |

FIG.25

| ROTATING POSITION | 0 | 1 | 2 | 3 | 4 | 5 | 6 | 7 | 8 | ----- | 16 | ----- | 64 | ----- | 127 |
|---|---|---|---|---|---|---|---|---|---|---|---|---|---|---|---|
| HORIZONTAL SHRINK SPECIFYING VALUE | 1 | 1 | 1 | 1 | 1 | 1 | 1 | 3 | 3 | ----- | 7 | ----- | 15 | ----- | 1 |

FIG.29

| LINE No. | LINE DATA | | | | | |
|---|---|---|---|---|---|---|
| | HORIZONTAL SHRINKAGE | VERTICAL SHRINKAGE | VERTICAL POSITION (Yn) | CHAIN BIT | NUMBER OF ACTIVE CHARACTER | HORIZONTAL POSITION (Xn) |
| 1 | 1 | 127 | Y0−0.5R | 0 | 16 | X0−R |
| ⇨ 2 | 3 | 152 | Y0−0.6R | 0 | 16 | X0−0.98R |
| ⋮ | ⋮ | ⋮ | ⋮ | ⋮ | ⋮ | ⋮ |
| 17 | 1 | 127 | Y0−0.5R | 0 | 0 | X0+R |
| ⋮ | ⋮ | ⋮ | ⋮ | ⋮ | ⋮ | ⋮ |
| 377 | 15 | 255 | Ys | 0 | 4 | Xs |
| 378 | 15 | 255 | — | 1 | 4 | — |
| 379 | 15 | 255 | — | 1 | 4 | — |
| 380 | 15 | 255 | — | 1 | 4 | — |

| ADDRESS IN THE WORK RAM | 1 | 2 | ・・・ | 13 | 14 | 15 | 16 | 17 | 18 |
|---|---|---|---|---|---|---|---|---|---|
| LINE SPRITE NUMBER | 2 | 3 | ・・・ | 14 | 15 | 377 | 378 | 379 | 380 |

FIG.32

| ADDR | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 0000 | 88 | FF | FF | FF | FF | FF | FF | FF | FF | FF | FF | FF | FF | FF | FF | FF |
| 0010 | FF | FF | FF | FF | FF | FF | FF | FF | FF | FF | FF | FF | FF | FF | FF | FF |
| 0020 | FF | FF | FF | FF | FF | FF | FF | FF | FF | FF | FF | FF | FF | FF | FF | FF |
| 0030 | FF | FF | FF | FF | FF | FF | FF | FF | FF | FF | FF | FF | FF | FF | FF | FF |
| 0040 | FF | FF | FF | FF | FF | FF | FF | FF | FF | FF | FF | FF | FF | FF | FF | FF |
| 0050 | FF | FF | FF | FF | FF | FF | FF | FF | FF | FF | FF | FF | FF | FF | FF | FF |
| 0060 | FF | FF | FF | FF | FF | FF | FF | FF | FF | FF | FF | FF | FF | FF | FF | FF |
| 0070 | FF | FF | FF | FF | FF | FF | FF | FF | FF | FF | FF | FF | FF | FF | FF | FF |
| 0080 | FF | FF | FF | FF | FF | FF | FF | FF | FF | FF | FF | FF | FF | FF | FF | FF |
| 0090 | FF | FF | FF | FF | FF | FF | FF | FF | FF | FF | FF | FF | FF | FF | FF | FF |
| 00A0 | FF | FF | FF | FF | FF | FF | FF | FF | FF | FF | FF | FF | FF | FF | FF | FF |
| 00B0 | FF | FF | FF | FF | FF | FF | FF | FF | FF | FF | FF | FF | FF | FF | FF | FF |
| 00C0 | FF | FF | FF | FF | FF | FF | FF | FF | FF | FF | FF | FF | FF | FF | FF | FF |
| 00D0 | FF | FF | FF | FF | FF | FF | FF | FF | FF | FF | FF | FF | FF | FF | FF | FF |
| 00E0 | FF | FF | FF | FF | FF | FF | FF | FF | FF | FF | FF | FF | FF | FF | FF | FF |
| 00F0 | FF | FF | FF | FF | FF | FF | FF | FF | FF | FF | FF | FF | FF | FF | FF | FF |

DATA

FIG.33

| ADDR | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 7F00 | 00 | 02 | 04 | 06 | 08 | 0A | 0C | 0E | 10 | 12 | 14 | 16 | 18 | 1A | 1C | 1E |
| 7F10 | 20 | 22 | 24 | 26 | 28 | 2A | 2C | 2E | 30 | 32 | 34 | 36 | 38 | 3A | 3C | 3E |
| 7F20 | 40 | 42 | 44 | 46 | 48 | 4A | 4C | 4E | 50 | 52 | 54 | 56 | 58 | 5A | 5C | 5E |
| 7F30 | 60 | 62 | 64 | 66 | 68 | 6A | 6C | 6E | 70 | 72 | 74 | 76 | 78 | 7A | 7C | 7E |
| 7F40 | 80 | 82 | 84 | 86 | 88 | 8A | 8C | 8E | 90 | 92 | 94 | 96 | 98 | 9A | 9C | 9E |
| 7F50 | A0 | A2 | 1A | 4A | 6A | 8A | AA | AE | B0 | B2 | B4 | B6 | B8 | BA | BC | BE |
| 7F60 | C0 | C2 | C4 | C6 | C8 | CA | CC | CE | D0 | D2 | D4 | D6 | D8 | DA | DC | DE |
| 7F70 | E0 | E2 | E4 | E6 | E8 | EA | EC | EE | F0 | F2 | F4 | F6 | F8 | FA | FC | FE |
| 7F80 | FF | FF | FF | FF | FF | FF | FF | FF | FF | FF | FF | FF | FF | FF | FF | FF |
| 7F90 | FF | FF | FF | FF | FF | FF | FF | FF | FF | FF | FF | FF | FF | FF | FF | FF |
| 7FA0 | FF | FF | FF | FF | FF | FF | FF | FF | FF | FF | FF | FF | FF | FF | FF | FF |
| 7FB0 | FF | FF | FF | FF | FF | FF | FF | FF | FF | FF | FF | FF | FF | FF | FF | FF |
| 7FC0 | FF | FF | FF | FF | FF | FF | FF | FF | FF | FF | FF | FF | FF | FF | FF | FF |
| 7FD0 | FF | FF | FF | FF | FF | FF | FF | FF | FF | FF | FF | FF | FF | FF | FF | FF |
| 7FE0 | FF | FF | FF | FF | FF | FF | FF | FF | FF | FF | FF | FF | FF | FF | FF | FF |
| 7FF0 | FF | FF | FF | FF | FF | FF | FF | FF | FF | FF | FF | FF | FF | FF | FF | FF |

DATA

FIG.34

| ADDR | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| FF00 | 00 | 01 | 02 | 03 | 04 | 05 | 06 | 07 | 08 | 09 | 0A | 0B | 0C | 0D | 0E | 0F |
| FF10 | 10 | 11 | 12 | 13 | 14 | 15 | 16 | 17 | 18 | 19 | 1A | 1B | 1C | 1D | 1E | 1F |
| FF20 | 20 | 21 | 22 | 23 | 24 | 25 | 26 | 27 | 28 | 29 | 2A | 2B | 2C | 2D | 2E | 2F |
| FF30 | 30 | 31 | 32 | 33 | 34 | 35 | 36 | 37 | 38 | 39 | 3A | 3B | 3C | 3D | 3E | 3F |
| FF40 | 40 | 41 | 42 | 43 | 44 | 45 | 46 | 47 | 48 | 49 | 4A | 4B | 4C | 4D | 4E | 4F |
| FF50 | 50 | 51 | 52 | 53 | 54 | 55 | 56 | 57 | 58 | 59 | 5A | 5B | 5C | 5D | 5E | 5F |
| FF60 | 60 | 61 | 62 | 63 | 64 | 65 | 66 | 67 | 68 | 69 | 6A | 6B | 6C | 6D | 6E | 6F |
| FF70 | 70 | 71 | 72 | 73 | 74 | 75 | 76 | 77 | 78 | 79 | 7A | 7B | 7C | 7D | 7E | 7F |
| FF80 | 80 | 81 | 82 | 83 | 84 | 85 | 86 | 87 | 88 | 89 | 8A | 8B | 8C | 8D | 8E | 8F |
| FF90 | 90 | 91 | 92 | 93 | 94 | 95 | 96 | 97 | 98 | 99 | 9A | 9B | 9C | 9D | 9E | 9F |
| FFA0 | A0 | A1 | A2 | A3 | A4 | A5 | A6 | A7 | A8 | A9 | AA | AB | AC | AD | AE | AF |
| FFB0 | B0 | B1 | B2 | B3 | B4 | B5 | B6 | B7 | B8 | B9 | BA | BB | BC | BD | BE | BF |
| FFC0 | C0 | C1 | C2 | C3 | C4 | C5 | C6 | C7 | C8 | C9 | CA | CB | CC | CD | CE | CF |
| FFD0 | D0 | D1 | D2 | D3 | D4 | D5 | D6 | D7 | D8 | D9 | DA | DB | DC | DD | DE | DF |
| FFE0 | E0 | E1 | E2 | E3 | E4 | E5 | E6 | E7 | E8 | E9 | EA | EB | EC | ED | EE | EF |
| FFF0 | F0 | F1 | F2 | F3 | F4 | F5 | F6 | F7 | F8 | F9 | FA | FB | FC | FD | FE | FF |

DATA

FIG.37

| HORIZONTAL SHRINK SPECIFYING VALUE \ PIXEL No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 0 | 0 | 0 | 0 | 0 | 0 | 0 | 0 | 0 | 1 | 0 | 0 | 0 | 0 | 0 | 0 | 0 |
| 1 | 0 | 0 | 0 | 0 | 1 | 0 | 0 | 0 | 1 | 0 | 0 | 0 | 0 | 0 | 0 | 0 |
| 2 | 0 | 0 | 0 | 0 | 1 | 0 | 0 | 0 | 1 | 0 | 0 | 0 | 1 | 0 | 0 | 0 |
| 3 | 0 | 0 | 1 | 0 | 1 | 0 | 0 | 0 | 1 | 0 | 0 | 0 | 1 | 0 | 1 | 0 |
| 4 | 0 | 0 | 1 | 0 | 1 | 0 | 0 | 0 | 1 | 0 | 0 | 0 | 1 | 0 | 1 | 0 |
| 5 | 0 | 1 | 1 | 1 | 1 | 0 | 1 | 0 | 1 | 0 | 0 | 0 | 1 | 0 | 1 | 0 |
| 6 | 0 | 0 | 1 | 1 | 1 | 0 | 1 | 0 | 1 | 0 | 0 | 0 | 1 | 0 | 1 | 0 |
| 7 | 0 | 0 | 1 | 1 | 1 | 0 | 1 | 0 | 1 | 0 | 0 | 0 | 1 | 0 | 1 | 0 |
| 8 | 0 | 0 | 1 | 1 | 1 | 0 | 1 | 0 | 1 | 0 | 0 | 0 | 1 | 0 | 1 | 0 |
| 9 | 0 | 0 | 1 | 1 | 1 | 0 | 1 | 0 | 1 | 0 | 0 | 0 | 1 | 0 | 1 | 0 |
| A | 1 | 0 | 1 | 1 | 1 | 0 | 1 | 0 | 1 | 0 | 0 | 0 | 1 | 0 | 1 | 0 |
| B | 1 | 0 | 1 | 1 | 1 | 0 | 1 | 0 | 1 | 0 | 0 | 0 | 1 | 0 | 1 | 0 |
| C | 1 | 0 | 1 | 1 | 1 | 0 | 1 | 0 | 1 | 0 | 0 | 0 | 1 | 0 | 1 | 0 |
| D | 1 | 0 | 1 | 1 | 1 | 0 | 1 | 0 | 1 | 0 | 0 | 0 | 1 | 0 | 1 | 0 |
| E | 1 | 1 | 1 | 1 | 1 | 0 | 1 | 0 | 1 | 0 | 0 | 1 | 1 | 0 | 1 | 0 |
| F | 1 | 1 | 1 | 1 | 1 | 1 | 1 | 0 | 1 | 0 | 0 | 1 | 1 | 1 | 1 | 0 |

1 : DISPLAY
0 : DELETE

DISPLAY CONTROLLING APPARATUS AND CONTROL METHOD THEREOF

BACKGROUND OF THE INVENTION

1. Field of the Invention

The present invention relates to a display control apparatus, and more particularly, to a display control apparatus and a method thereof which allows easy control of a display apparatus and a small size of memory used in displaying images on a display screen.

2. Description of the Related Art

In a display screen of a computer or a game machine, moving objects such as a fighter aircraft, a player and a ball which move on the display screen are overlapped on the background. In that case, usually, memory for the background images and memory for the moving objects are installed separately in the computer or the game machine, and the moving objects are moved on the display screen by changing a display position of the moving objects. The technique is generally referred to as a sprite controlling technique by those who are skilled in the art.

FIG. 1 shows a construction of V-RAM 202 in the sprite controlling technique disclosed in Japanese Kokai publication No. HEI 6-83320. Character patterns for a background image are stored in a character storing part 206. In this example, one character consists of a total of 64 dots, that is 8 dots in vertical direction and 8 dots in horizontal direction. Also, a character code is provided to each of the character patterns.

On the other hand, the display screen is divided into a plurality of regions each of which corresponds to the size of a character as shown in FIG. 2. In this example, the display screen is divided into a plurality of regions of 32 (in vertical direction) times 32 (in horizontal direction), and the divided regions are numbered with 0 to 3 FF respectively. A plurality of storing regions each of which corresponds to each of the regions as described above are provided in a background instruction part 204 shown in FIG. 1, and different character codes of desired characters are specified in the storing regions (see FIG. 3). Display data are generated by a controlling circuit (not shown) based on the stored information in the character storing part 206 and the background instruction part 204. Thus, a background image is displayed on the display screen.

Character pattern and character codes for sprite are stored in a character storing part 210 shown in FIG. 1. The data shown in FIG. 4 are stored in a sprite instruction part 208, that is, X coordinate, Y coordinate on the display screen of a desired character, and a desired character code are specified. The controlling circuit (not shown) displays a sprite based on the stored information in the character storing part 210 and the sprite instruction part 208. Also, display of the sprite can be moved by changing the X coordinate and Y coordinate of the desired character (see FIG. 4).

The data structure shown in FIG. 3 and FIG. 4 is simplified for easy explanation. Color data and display priority or the like are included in addition to the data.

However, there are the following disadvantages in a display controlling apparatus in the related art described hereinbefore.

Firstly, since the display of the background image is almost inflexible, it is not easy to move the background images smoothly on the display screen. A huge number of different images have to be stored in memory when a smooth movement of the background is required.

Secondly, different control circuits are required for controlling the background images and for controlling of the sprite. Therefore, the structure of the apparatus is complex. Also, complicated computer software is required to control the background images.

Meanwhile, there is a case to display a spherical object such as the earth or the like in rotation. In that case, a plurality of slightly different display image patterns each of which shows the spherical object rotated in different phases are prepared, and then the rotating spherical object is displayed on a CRT (display screen)by successively changing the display image patterns using computer software. Thus, it is possible to display the spherical object in rotation for a game player or for a person watching the display screen.

However, it is required to have a huge number of display image patterns to be changed in a given period of time in order to display the spherical object being rotated smoothly using a predecessor computer game machine. Accordingly, the size of the memory storing the display image patterns must be large. In addition, CPU is overloaded to execute the above-mentioned display. In the worst case, other jobs are suspended during the execution of the above display. On occurrence of such situation, a game player cannot play a game and is irritated by that situation due to the suspension.

To resolve the above-described problems, it is considered to use a powerful CPU or an extension processor. Although this approach can simply avoid the suspension of game programs, production cost of the computer game machine is increased. Moreover, even the above approach still requires a large size of memory.

SUMMARY OF THE INVENTION

It is an object of the present invention to resolve the above described problems and provide a display control apparatus and a method for controlling display images which has flexibility and allows easy display control in simple structure.

A display control apparatus for displaying characters in line sprite units, each line sprite including a plurality of characters each of which includes pixels, the apparatus in accordance with the present invention comprises:

a plurality of different characters, each of the characters having a plurality of pixels provided in vertical and horizontal directions;

a specification means for specifying the number and location of characters to be displayed in vertical direction or horizontal direction;

a control means, responsive to a specification of the specification means, for selecting the characters to be displayed on the display screen from the plurality of characters and for controlling the display of the selected characters.

A display control method for displaying characters in line sprite units, each line sprite including a plurality of characters each of which includes pixels, the method in accordance with the present invention comprises the steps of:

specifying the display position and number of characters to be displayed in a vertical direction or horizontal direction on a displayed screen;

selecting characters from the plurality of characters; and displaying the selected characters on the display screen.

A display control apparatus for displaying a rotating three-dimensional object in accordance with the present invention comprises:

means for storing display image data corresponding to each of the divided regions obtained by dividing the surface of the three-dimensional object into a plurality of regions, means for storing display position data for each of the divided regions being varied in accordance with rotation of the object, means for storing image size data provided in accordance with a display position of each divided region of the object, and means for controlling display of the image of each of the divided regions in accordance with the display position data and the image size data of each of the divided regions.

A method for controlling display of a rotating three-dimensional object in accordance with the present invention comprises the steps of:

obtaining display image data corresponding to each of the divided regions obtained by dividing the surface of the three-dimensional object into a plurality of regions, obtaining both display position data being varied in accordance with rotation of the three-dimensional object and image size data corresponding to a display position of each divided region of the three-dimensional object, and controlling display of the image of each of the divided regions in accordance with the display position data and the image size data of each of the divided regions.

BRIEF DESCRIPTION OF THE DRAWINGS

The above and other objects, advantages and features of this invention will be more fully understood when considered in conjunction with the following figures, in which like numerals designate like or corresponding components and of which;

FIG. 5 is a view illustrating a data structure of V-RAM 24 for a display controlling circuit 18 in an embodiment of the present invention.

FIG. 11 B is a view virtually illustrating a line sprite when horizontal shrinkage of the line sprite is carried out.

FIG. 11 C is a view virtually illustrating a line sprite when vertical shrinkage of the line sprite is carried out.

FIG. 17 is a view illustrating an example of line data of the data stored in V-RAM 24.

FIG. 19 A is a view illustrating a display table in the controller 26.

FIG. 19 B is a view illustrating a display table in the controller 26.

FIG. 25 is a view illustrating a part of a table describing a relationship between rotating positions and horizontal shrink ratio specifying values of the line sprites.

FIG. 29 is a view illustrating an example of line data of the data stored in V-RAM 24.

FIG. 32 is a view illustrating partial contents of a table showing a vertical shrink display pattern of a ROM 30 for shrink data.

FIG. 33 is a view illustrating partial contents of a table showing the vertical shrink display pattern of the ROM 30 for shrink data.

FIG. 34 is a view illustrating partial contents of a table showing the vertical shrink display pattern of the ROM 30 for shrink data.

FIG. 37 is a view illustrating contents of a table for outputting a shrink display pattern in horizontal direction made by a hardware logic in the controller 26.

DETAILED DESCRIPTION OF THE PREFERRED EMBODIMENT

Figure 1:
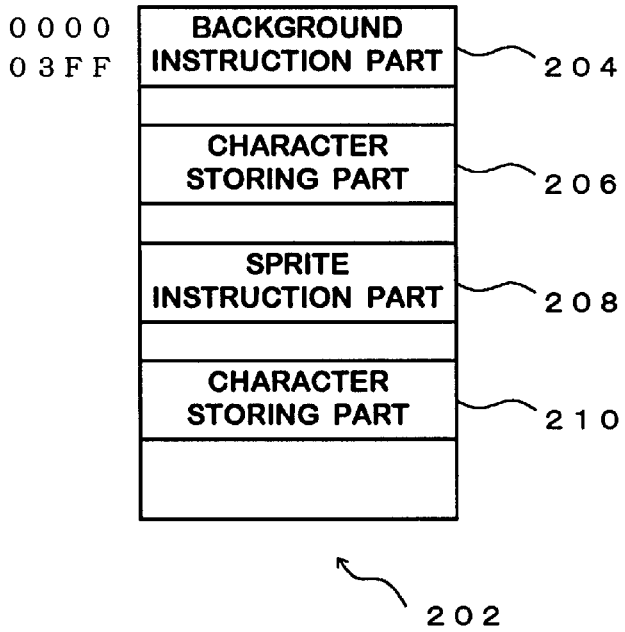
FIG.1 (RELATED ART)
FIG. 1 is a view illustrating a storing structure of V-RAM of a display control apparatus in the related art.
Figure 2:
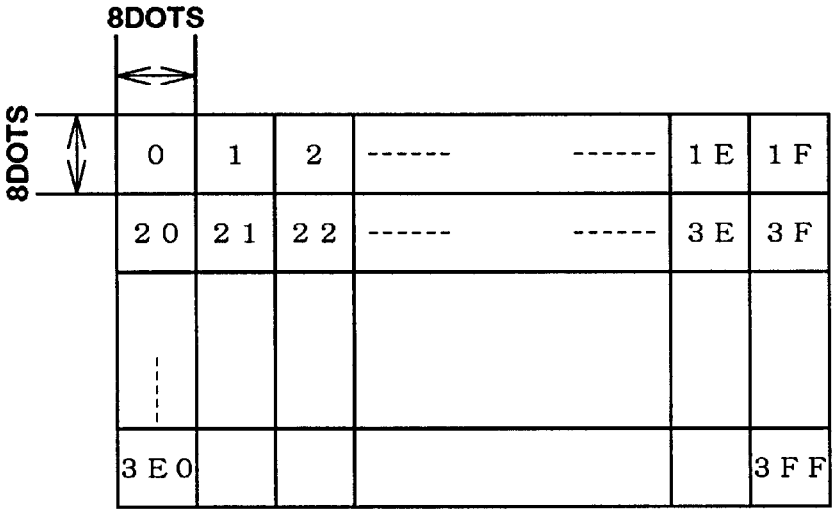
FIG.2 (RELATED ART)
FIG. 2 is a view illustrating active area of a display screen.
Figure 3:
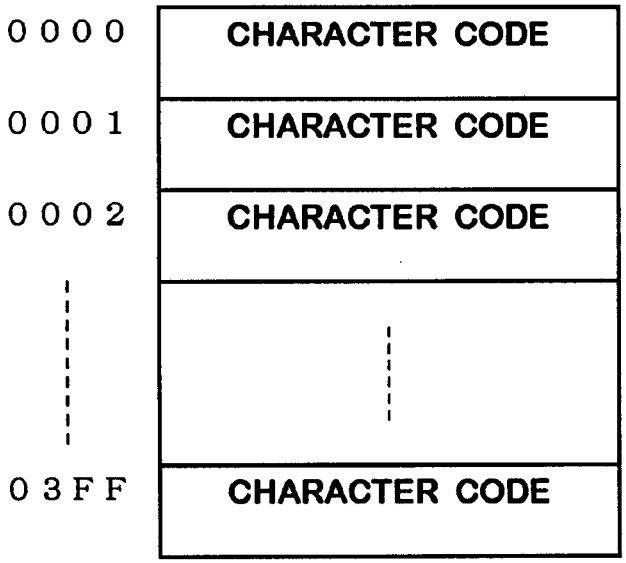
FIG.3 (RELATED ART)
FIG. 3 is a view illustrating a data structure of a background image.
Figure 4:
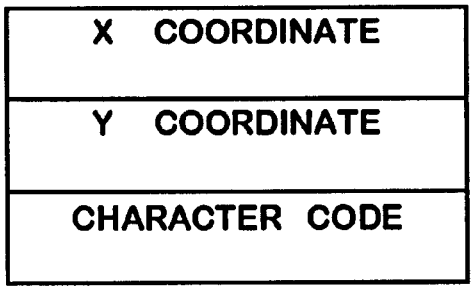
FIG.4 (RELATED ART)
FIG. 4 is a view illustrating a data structure of a sprite.
Figure 6:
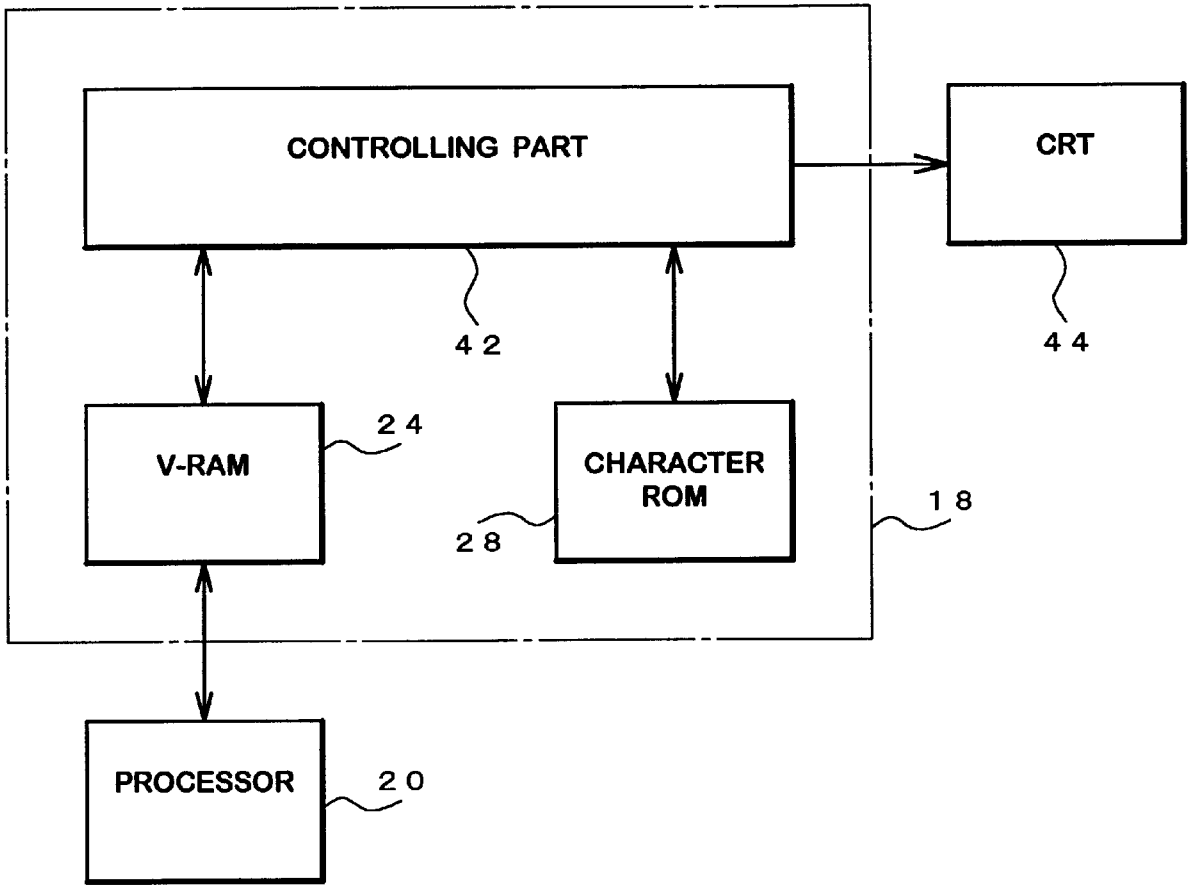
FIG. 6 is a view illustrating a structure of a display controlling apparatus 18 and peripherals which accomplish functions of a display control apparatus according to an embodiment of the present invention.

FIG. 6 shows a display controlling circuit 18 according to an embodiment of the present invention. A processor 20 writes data for display into a V-RAM 24 which functions as a display specification unit. Following loading the contents of V-RAM 24, a controlling unit 42 reads out character pattern data successively from a character ROM 28 which functions as a character storing means. Display data read out from the V-RAM 24 are converted into analog display signals of R, G, B by the controlling unit 42, and outputted. These signals are received and displayed on a CRT 44. The processor 20 can change a display image on the CRT 44 by updating the data stored in the V-RAM 24.

Figure 8:
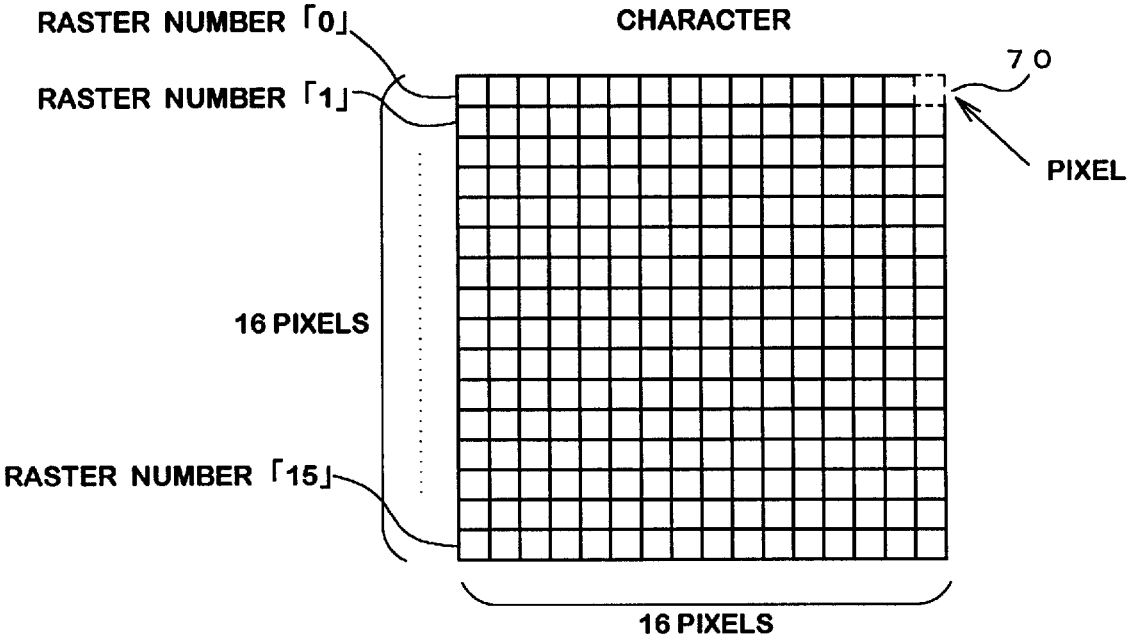
FIG. 8 is a view illustrating a data structure of a character.

Display data of the characters each of which has 16 dots (in vertical direction) times 16 dots (in horizontal direction) are stored in the character ROM 28 as shown in FIG. 8. A character is assumed to consist of 16 dots (in vertical direction) times 16 dots (in horizontal direction) corresponding to a pixel block consisting of 16 pixels (in vertical direction) by 16 pixels (in horizontal direction) on the CRT 44. Color data for each pixel 70 are formed of 4 bits, and a displayed color is specified by the 4 bit data. Further, different display pattern data are stored and numbered.

A plurality of memory regions are provided in the V-RAM 24 as shown in FIG. 5. In order to specify the data for characters to be displayed sequentially in vertical direction on a CRT (display screen), regions $C_{1,0}$, $C_{1,1}$, $C_{1,2}$, . . . $C_{1,31}$ are prepared in the V-RAM 24. The line of characters specified by the regions $C_{1,0}$, $C_{1,1}$, $C_{1,2}$, . . . $C_{1,31}$ are referred to as "line 1" or "line sprite 1". Further, region $L_1$ for specifying display positions and the number of characters displayed on the display screen etc. of the "line 1" is provided. In the same way, a plurality of regions for "line 2" to "line 380" are provided. In this embodiment, a region for each line sprite is a line display specification means. That is, a total of 380 line display specification means $L_1$, $L_2$, . . . and $L_{380}$ are provided in the V-RAM 24. Each of the regions for specifying data of characters $C_{1,0}$, $C_{2,0}$ to $C_{2,31}$ . . . (regions of respective character data) is a character specification means.

Figure 9:
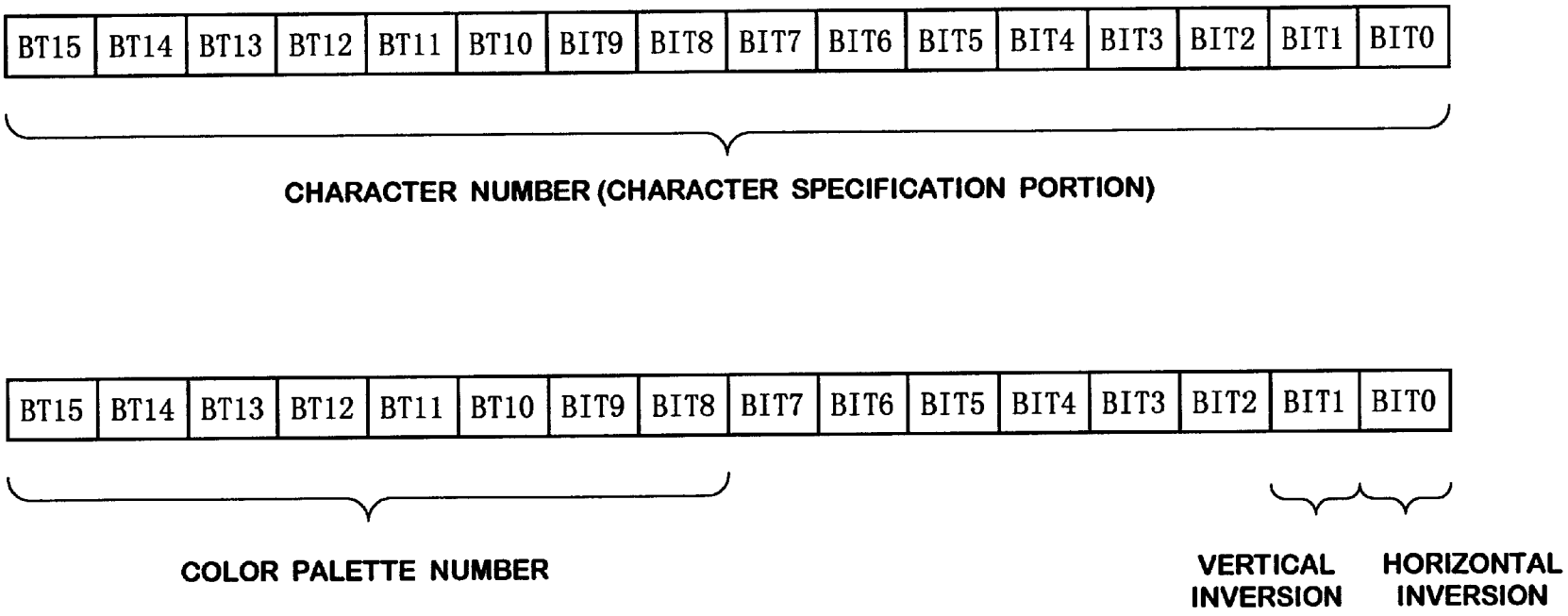
FIG. 9 is a view illustrating a detailed data structure for each character.

FIG. 9 shows a detail structure of region $C_{1,0}$ which specifies data of a character. The region $C_{1,0}$ is formed of 32 bits (4 bytes). Further, the region $C_{1,0}$ comprises a region for storing the character number of a character (a first means or character specification means) stored in the character ROM 28, a region for specifying a color palette number which identifies a color palette, a region for specifying an inversion in the vertical direction, and a region for specifying an inversion in the horizontal direction. The controlling unit 42 carries out the following steps to determine a display color of each pixel. The color palette corresponding to the color palette number is selected and then color data is selected from the color palette in accordance with the specification of color for each pixel of the character. The other regions such as regions $C_{1,1}$, $C_{1,2}$, . . . $C_{1,31}$, . . . $C_{380,31}$ have the same structure as shown in FIG. 9. That is, it is possible to specify a specific color palette, and specify inversion in the vertical or horizontal direction for each character.

Figure 11A:
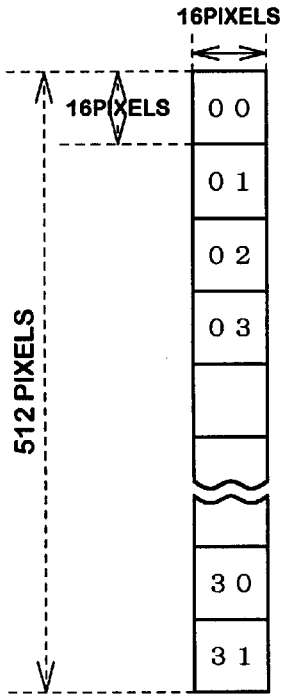
FIG. 11 A is a view virtually illustrating a line sprite when shrinkage of the line sprite is not carried out.
Figure 11B:
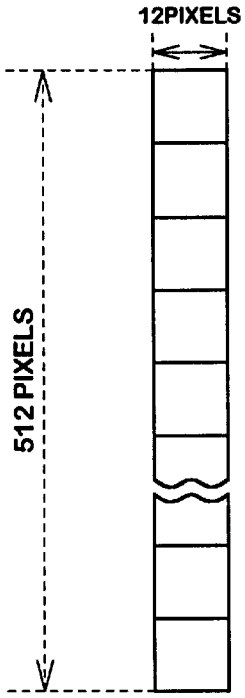
Figure 11C:
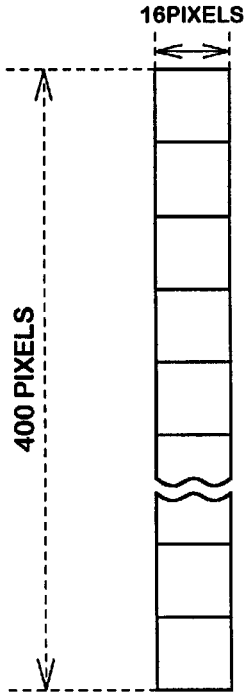

FIG. 11 A shows a view schematically illustrating the characters (line 1) specified in the regions $C_{1,0}$ to $C_{1,31}$ shown in FIG. 5. The character displayed on a position of 00 in the Figure is the character specified at the region $C_{1,0}$. In the same way, the characters specified in the regions $C_{1,1}$, $C_{1,2}$, . . . $C_{1,31}$ are displayed at the positions of 01, 02 . . . and 31, respectively. In other words, 32 characters are provided in the vertical direction sequentially. In the same way, a total of 32 characters are provided in the vertical direction for each of the line sprites 2 to 380. In this embodiment, all the characters shown in FIG. 11 A are not displayed on the CRT, for instance, if the CRT 44 has 240 pixels in the vertical direction and 320 pixels in the horizontal direction. It is determined by specifying active characters and their display positions as to which characters are displayed.

Figure 10:
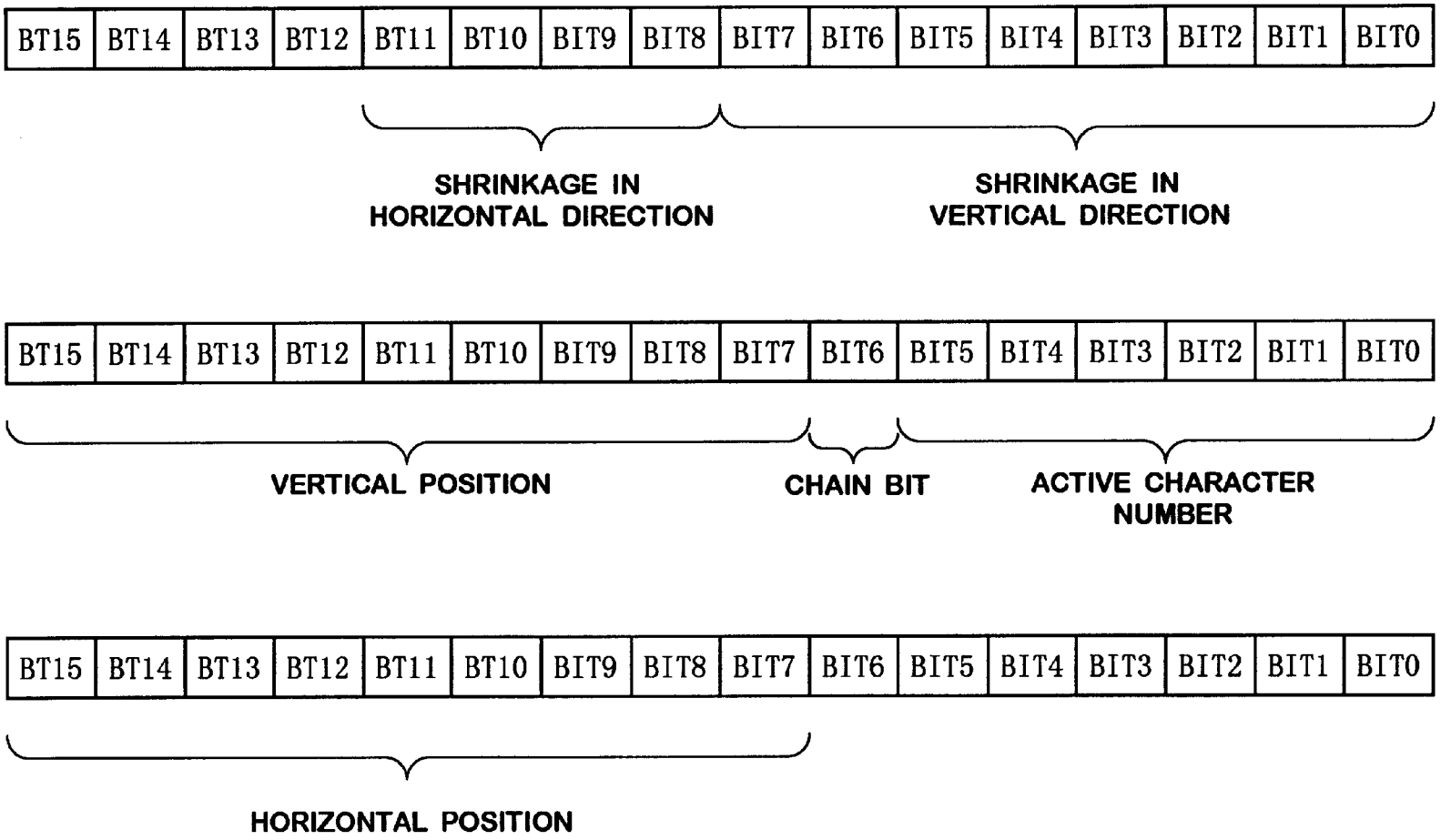
FIG. 10 is a view illustrating a detailed data structure for a line sprite.

The regions $L_1$ to $L_{380}$ (see FIG. 5) for specifying the display position and other data as to each line sprite are provided. FIG. 10 shows a detail structure of the region $L_1$. The region $L_1$ consists of 48 bits (6 bytes) of data. The region $L_1$ comprises a region for specifying vertical and horizontal shrinkage, a region for specifying a display position in the vertical direction (a vertical display position) and a region for specifying a display position in horizontal direction (a horizontal display position) (a second means for a display position specification means), a region for specifying the number of characters (active characters) to be displayed on the CRT, (a third means for a character number specification means) and a region for specifying the sequence of adjacent line sprite 2 (a sequence specification means, that is, a chain bit).

Figure 12:
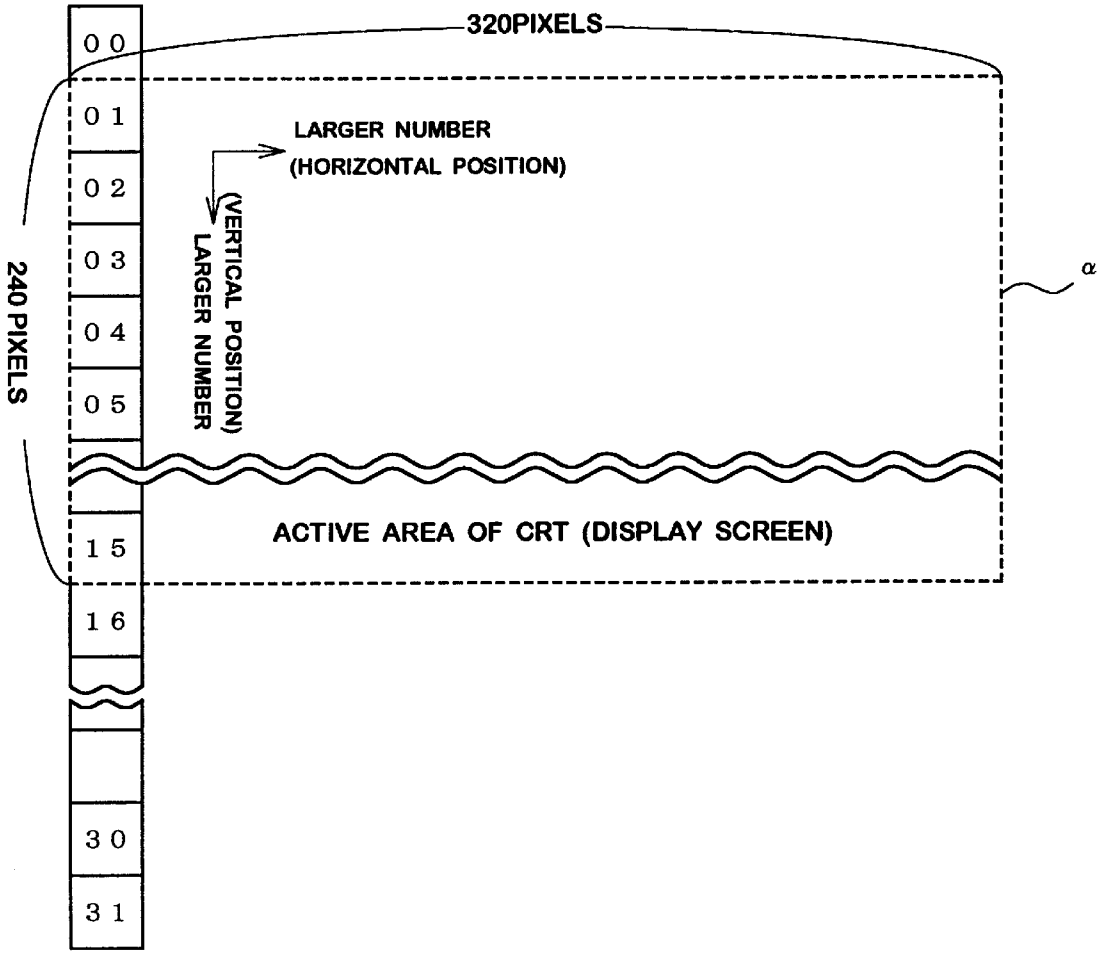
FIG. 12 is a view illustrating a relationship between a line sprite and the active area of the display screen.

FIG. 12 illustrates how the line 1 shown in FIG. 11 A is displayed when both vertical and horizontal positions are specified to as 0. Since 16 dots on both upper and lower sides of the display screen (CRT 44) are inactive areas, the character positioned at 00 is not displayed on the display screen when the vertical position is specified as 0. The active area of the CRT 44 is shown by a broken line α. That is, the characters positioned at 01, 02, 03, . . . and 15, are displayed on the CRT. In other words, it is possible to shift the display position in pixel units toward the lower side of the display screen by incrementing the vertical position. Further, it is also possible to shift the display position in pixel units toward the right hand side of the display screen by incrementing the horizontal position.

For instance, when 32 is specified in the region shown in FIG. 10 for specifying the number of active characters, a total of 32 characters starting from 00 are displayed (the pixels corresponding to the characters are activated) as shown in FIG. 11 A. Further, when the number of active characters is specified as 10 in a relation shown in FIG. 12, only the characters positioned from 01 to 09 are displayed on the display screen and the characters positioned from 10 to 15 are not displayed by the controlling unit 42, though the characters positioned from 10 to 15 exist in the active area α of the CRT. Of course, the character positioned at 00 is not displayed on the display screen, because the character is out of the active area. When the number of active characters of the line is specified as 0, the line is not displayed on the display screen by the controlling unit 42.

Figure 13:
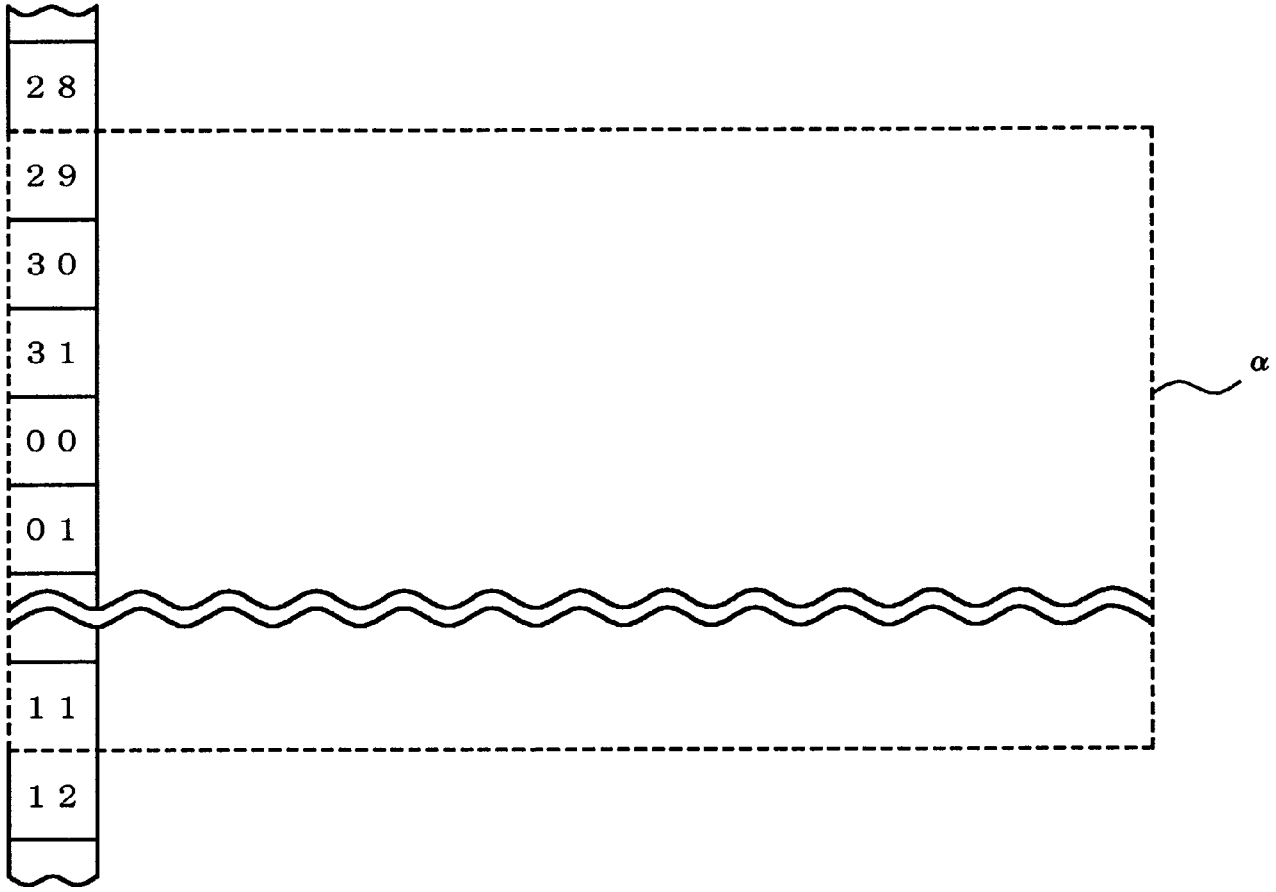
FIG. 13 is a view illustrating a relationship between a line sprite and the active area.

In the case where the number of active characters is specified as 32, the controlling unit 42 can control the circuit to display the character of 00 next to the character of 31 as shown in FIG. 13 when the character of 31 is moved into the active area α. Thus, it is possible to endlessly scroll the line vertically.

The region for specifying shrinkage in horizontal direction shown in FIG. 10 is a region for specifying a shrinkage level in the horizontal direction on the display screen. In the region, any number can be selected from 00 to 15 and specified. Shrinkage in the horizontal direction is carried out by using an image shrink ratio of "(specified number+1)/16". In other words, only the pixels the number of which is specified by "horizontal shrink specifying value+1" are displayed over the line next to each other on the display screen. For instance, a total of 12 pixels are displayed over the lien and 4 pixels are removed from the 16 pixels when 11 is specified as a "specified number." When 15 is specified as a "specified number," shrinkage is not carried out.

The region for specifying a shrinkage in the vertical direction shown in FIG. 10 is a region for specifying a shrinkage level in vertical direction on the display screen. Any one from the numbers of 0 to 250 can be specified. Shrinkage in vertical direction is carried out by using an image shrink ratio of "(specified number+1)/256." In other words, only the pixels the number of which is specified by "(vertical shrinkage specifying value+1)×2" are displayed next to each other on the display screen when the number of pixels for the vertical direction of a line sprite equals to 512 (equivalent to 32 characters). For instance, a total of 400 pixels are displayed next to each other on the display screen as a result of the shrinkage when 199 is specified as a "specified number." When 255 is specified as a "specified number," shrinkage is not carried out. The regions for specifying "specified numbers" of shrinkage in both horizontal and vertical directions form a size specification means (an image size specification means).

Figure 14:
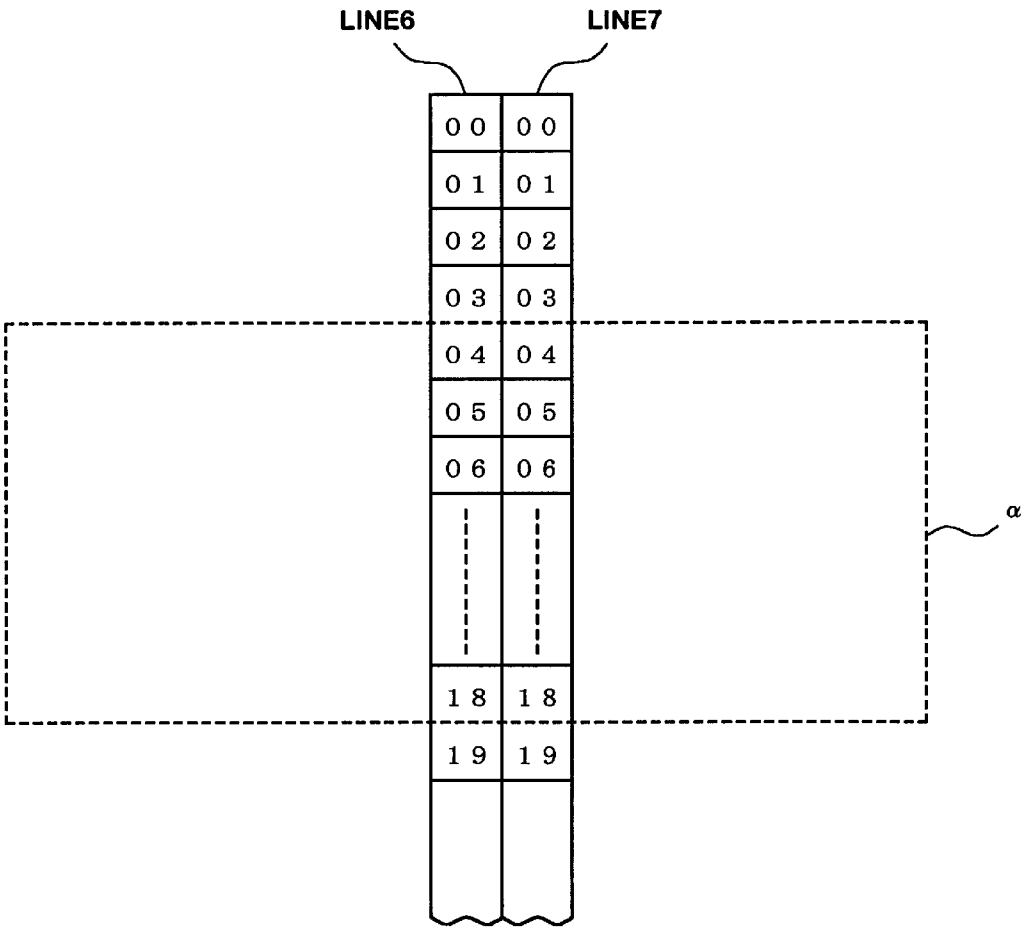
FIG. 14 is a view illustrating a display on the display screen when value of chain bit is specified as 1.

When the chain bit shown in FIG. 10 is specified as 1, the line is displayed at the right hand side of the previous line, in spite of both the specified vertical and horizontal positions. For example, when the chain bit of "line 7" shown in FIG. 14 is specified as 1, "line 7" is displayed at the right hand side of the "line 6" (the vertical positions of these lines are the same position). Also, when the chain bit is specified as 0, the display position of the line is determined by the specified vertical and horizontal positions.

In this embodiment, when more than two lines are specified on the same coordinate, the controlling unit 42 controls circuits to display the characters of the line sprite having the largest line number of the lines. Further, when pixels of the characters for the line sprite having the highest priority are specified as transparent ones (no specification for color), the controlling unit 42 controls circuits to display the pixels, which are behind the transparent pixels, of characters for the line sprite having the second highest priority.

Next, an operation for displaying a background and an object using line sprites using the above-constructed display control apparatus will be described. Initially, a background larger than the active area $\alpha$ is generated by specifying each of the characters of "line 1" to "line 32" by writing data into the V-RAM 24 using the processor 20. Meanwhile, the chain bits (see FIG. 10) of the "line 2" to the "line 32" are specified as 1. Thus, display positions of the "line 2" to the "line 32" are determined automatically based on a display position of the "line 1." In this embodiment, both vertical and horizontal display positions of the "line 1" are specified as 0 and 0 respectively. Thus, the background can be specified easily.

Figure 16:
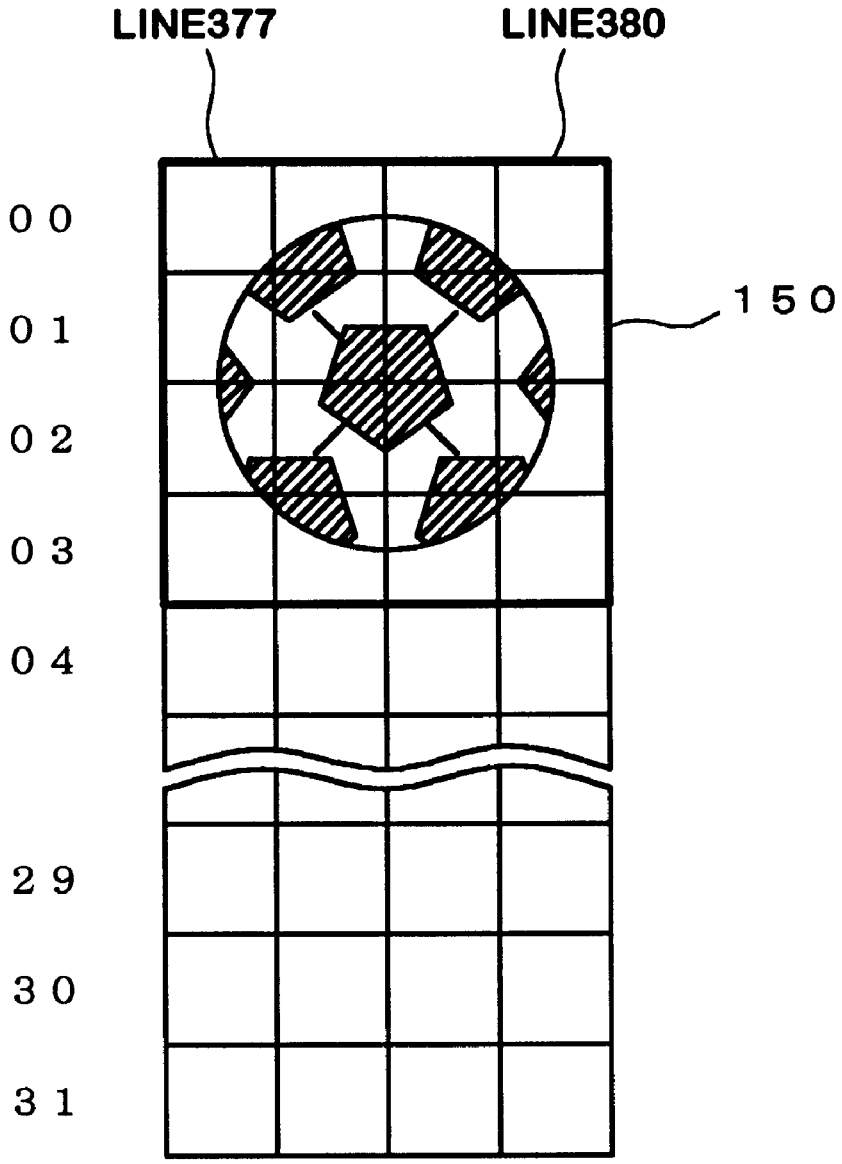
FIG. 16 is a view illustrating a display formed by a plurality of line sprites.

Next, an object is generated by specifying each of the characters from "line 377" to "line 380" as shown in FIG. 16. Meanwhile, each chain bit (see FIG. 10) of the "line 378" to the "line 380" is specified as 1. Thus, display positions of the "line 378" to the "line 380" are determined automatically based on a display position of the line 377. Further, the number of active characters (see FIG. 10) in each line is specified as 4. Thus, an object 150 having a total of 64 pixels in the vertical direction and 64 pixels in the horizontal direction can be specified. Both of the vertical and horizontal display positions are specified by a game program executed by the processor 20.

Figure 15:
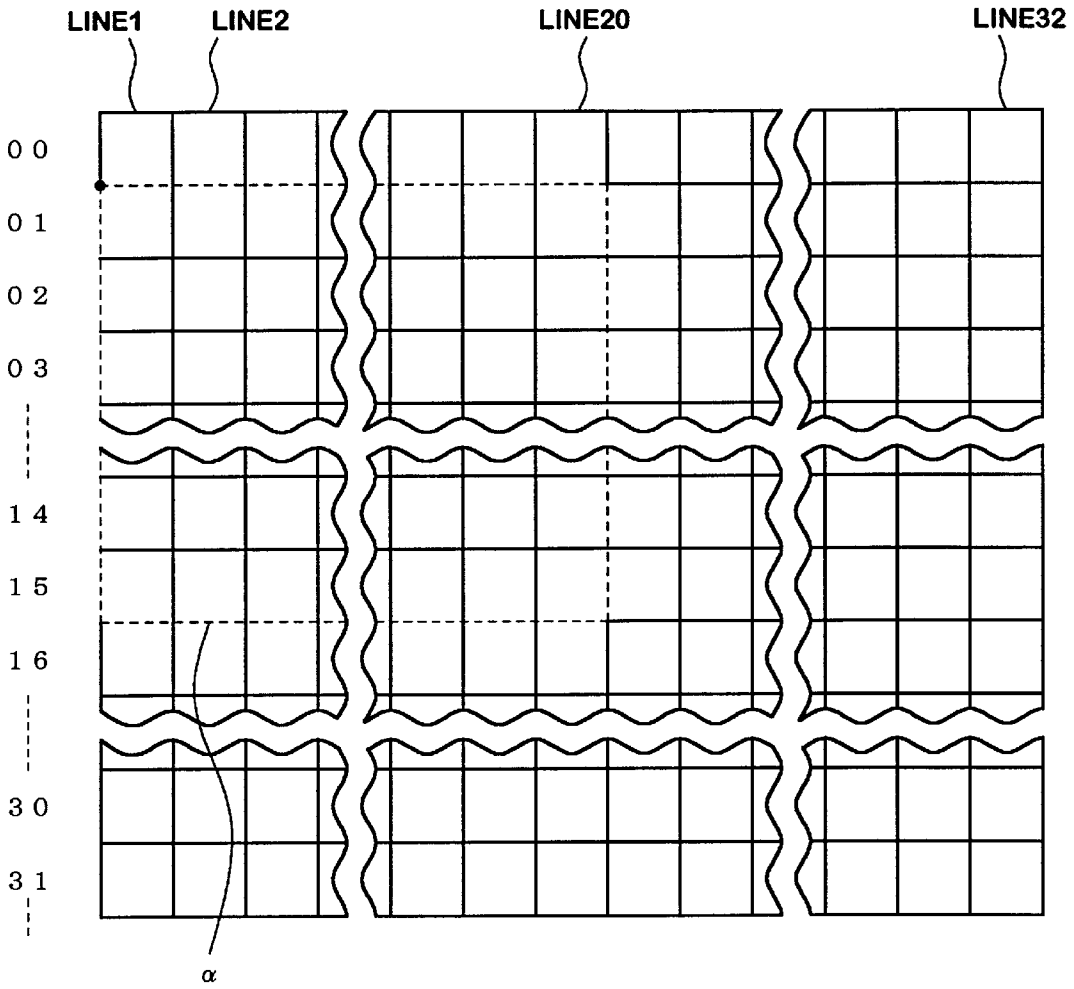
FIG. 15 is a view illustrating a display of the background.

From the V-RAM 24, the controlling unit 42 reads data such as the vertical position, horizontal position, and specified numbers for horizontal and vertical shrinkage. The controlling unit 42 reads pixel data for one raster from the character ROM 28 based on the data read from the V-RAM 24. The data read out from the character ROM 28 are converted into analog display signals of R, G, B, and are displayed on the CRT 44. Upon completion of the operation for one raster, another operation is carried out for the next raster. These operations are carried out for 240 rasters to display the background. In the above-described operation, there is an area where the object 150 shown in FIG. 16 is displayed. In the area, the object 150 is overlapped on the background shown in FIG. 15. Since the object 150 has the higher priority than the background, the object 150 is displayed on the background by the controlling unit 42. Thus, the object 150 is displayed on the background.

In order to move the object 150 to other position, the vertical and horizontal positions of the "line 377" are changed. Corresponding to the change, the controlling unit 42 moves the object 150 to the points specified by the vertical and horizontal positions. That is, it is possible for the processor 20 to move the positions of the object 150 by changing both of the vertical and horizontal positions of the "line 377."

Further, in order to erase the object 150, the number of active characters in each of the "line 377" to the "line 380" is specified 0. This function is preferably applied to a game which contains objects being disappeared during the game such as a shooting game and the like. Even when the number of active characters is specified as 0, the data shown in FIG. 16 is still existing. The object 150 can be displayed again by specifying the number of active characters as 4. Therefore, it is easy and speedy to control appearance and disappearance of the object.

In order to display the object in a shrunken state (for instance an object is going far away), both horizontal and vertical shrinkages in the "line 377" to the "line 380" are specified.

In order to scroll the background, both vertical and horizontal positions of the "line 1" are changed. Corresponding to the change, the background is moved and displayed on the CRT by the controlling unit 42. In other words, it is possible for the processor 20 to perform a make-believe movement of the object 150 by changing both of the vertical and horizontal positions of the "line 1." Further, a circulating scroll can be carried out by connecting the line 32 and the line 1.

Thus, data such as display positions and shrinkages are treated in line sprite units, and character numbers, color palette numbers are treated in character units in the present invention, enhancing flexibility of display and allowing easy change of display. The controlling unit 42 can be simplified and execute game programs easily. Further, only one number is used to specify display positions of characters of a line sprite (32 characters) or to specify display positions of the characters of a plurality of line sprites when they are displayed next to each other, allowing use of a small size memory compared with that of a display position having to be specified for every character.

Figure 7:
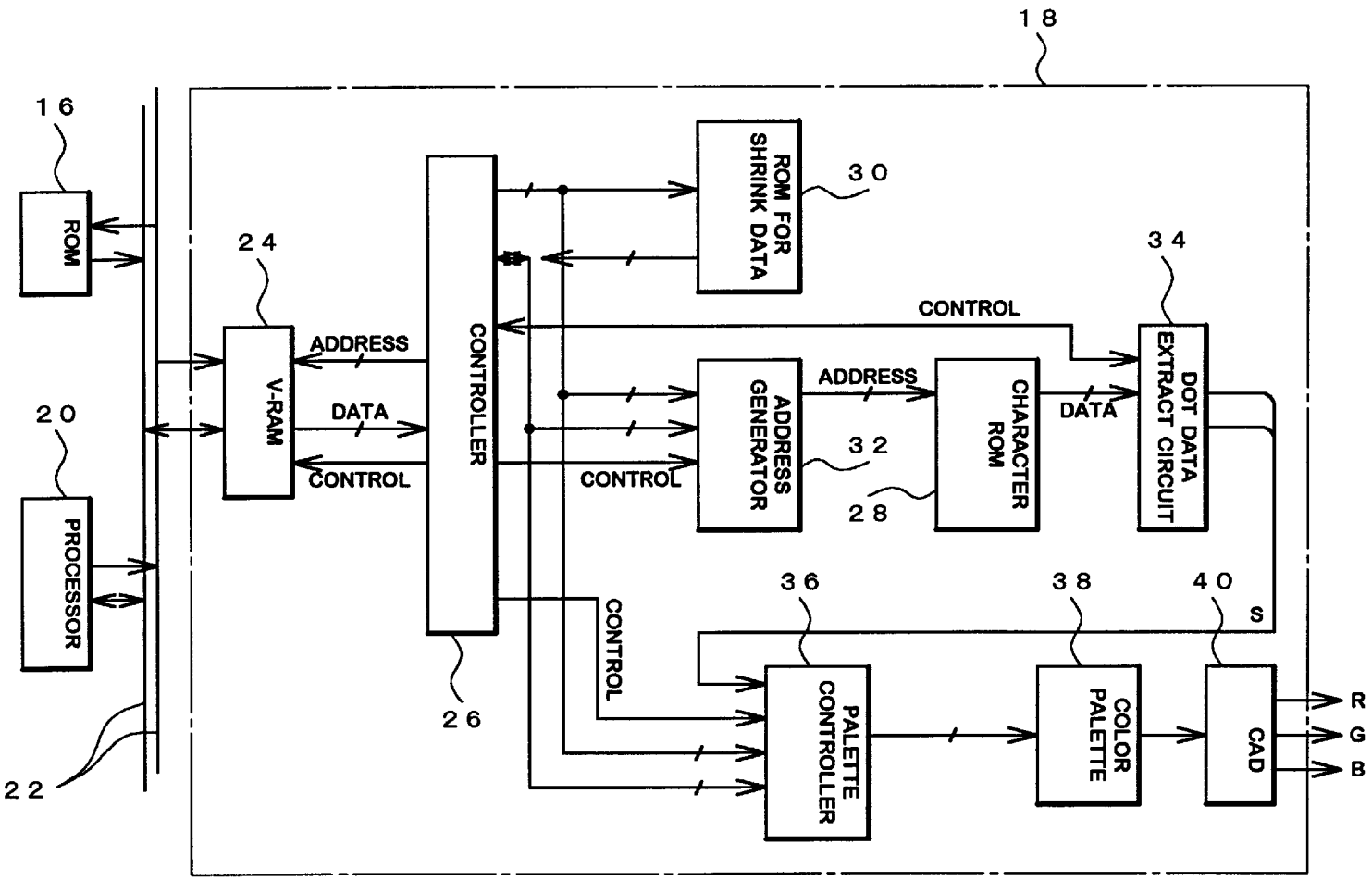
FIG. 7 is a detail view of the controlling unit 42 shown in FIG. 6.

FIG. 7 shows a detailed structure of the controlling unit 42 shown in FIG. 6. The processor 20 stores the data shown in FIG. 5 into the V-RAM 24 via a bus line 22. Line data contained in the data stored in the V-RAM 24 are shown in FIG. 17 as an example (character data shown in FIG. 5 is not illustrated in the FIG. 17). The data stored in the V-RAM 24 are read out by the controller 26. The controller 26 determines display configuration in the active area $\alpha$ of the CRT in accordance with the display positions, priority of display and character number of individual character data of line data of "L1" to "L380."

Figure 18:
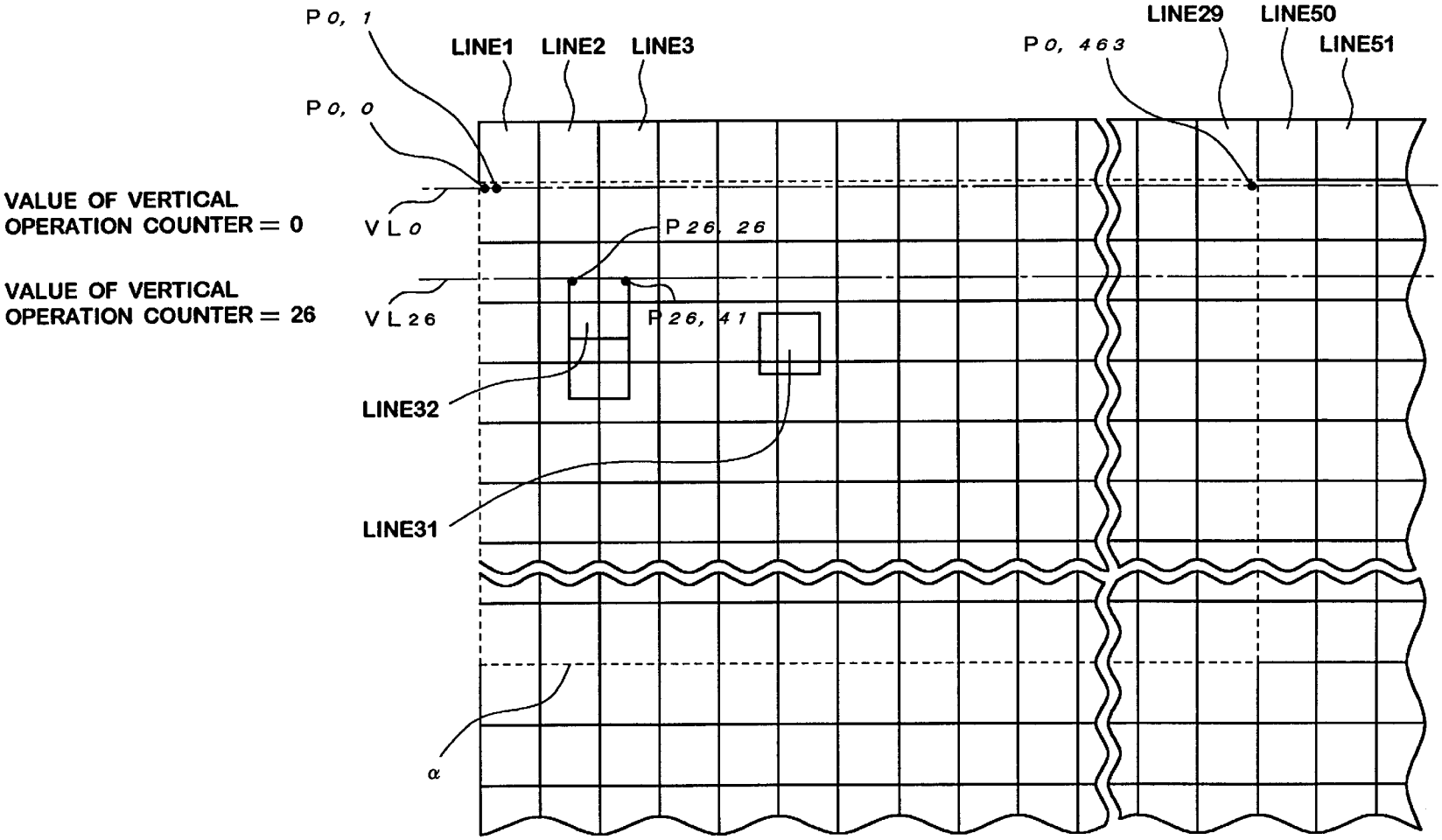
FIG. 18 is a conceptual view for describing an execution of a controller 26.

Operation of the controller 26 will be described below. FIG. 18 shows a conceptual view for describing an execution of the controller 26.

First of all, the controller 26 resets an internal vertical operation counter (not shown) to 0. The vertical operation counter indicates a vertical position for operation by the controller 26. As shown in FIG. 18, an operation is applied to the uppermost raster $VL_0$ of the active area α (hereinafter referred to as the row $VL_0$) when the value of the vertical operation counter equals 0. In FIG. 18, it is assumed that the active area α consists of 256 pixels in the vertical direction and 464 pixels in the horizontal direction. Therefore, the operation is carried out from the row $VL_0$ to the 255th row $VL_{255}$ sequentially.

The controller 26 determines whether or not there is a line sprite to be displayed on the row $VL_0$ in accordance with the line data of each line sprite. In this embodiment, the controller 26 determines that the line 1 must be displayed on the row $VL_0$ in accordance with the line data of the line 1 (see FIG. 17). Accordingly, the controller 26 writes into a display table of an internal work RAM (not shown) data that indicates the line 1 must be displayed on the display screen.

The display table has a total of 464 segments, the number of which corresponds to the number of pixels, that is, 464 pixels, in the horizontal direction of the display area α. Line sprite number 1 is stored into the storing segments 0 to 15 as shown in FIG. 19. This means that the line 1 must to be displayed using the pixels 0 to 15 of the row $VL_0$.

Next, the controller 26 also determines whether the line 2 must be displayed on the row $VL_0$ or not. Since the controller 26 determines that the line 2 must be displayed on the row $VL_0$, line sprite number 2 is stored into the storing segments 16 to 31 which correspond to the pixels 16 to 31. This means that the line 2 must be displayed using the pixels 16 to 31 of the row $VL_0$.

In the same way, the controller 26 determines whether each of the other line sprites 3 to 380 must be displayed on the row $VL_0$ or not. Then line number of lines to be displayed on the screen is stored into storing segments of the display table. For instance, the line 31 and the line 32 are not displayed on the row $VL_0$. the line numbers of these lines are not stored into the storing segments of the display table. Although the lines 50, and 51 exist on the row $VL_0$, these lines are out of the active area α of the CRT. Therefore, the line numbers 50, 51 of these lines are not stored in the storing segments of the display table.

The display table generated in the above-described way as to the row $VL_0$ is shown in FIG. 19 A. The controller 26 carries out following display control in accordance with the display table thus generated.

Figure 20:
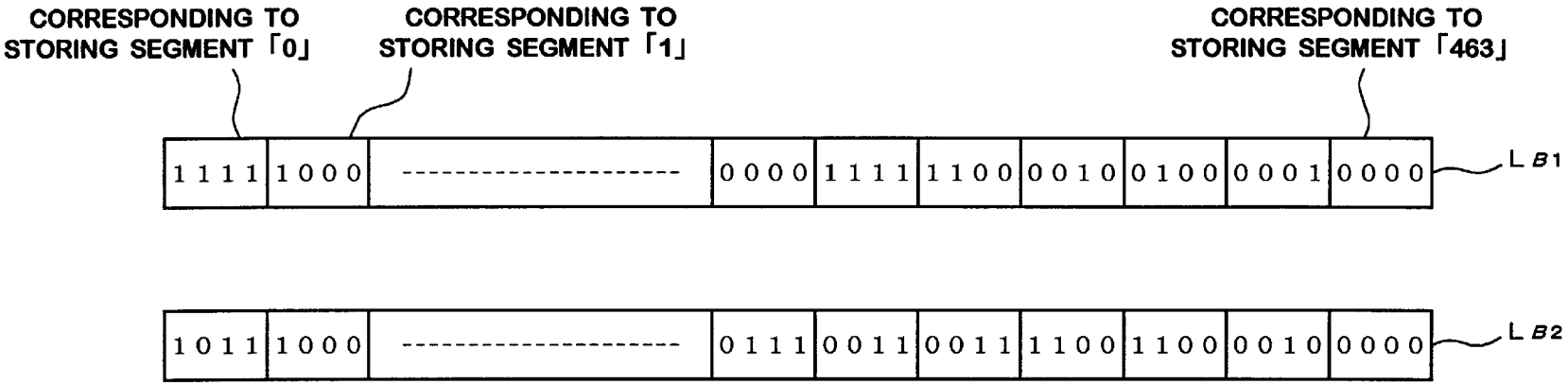
FIG. 20 is a view illustrating contents of line buffer $LB_1$ and line buffer $LB_2$.

First of all, the controller 26 reads out the line number 1 stored in the storing segment 0 of the display table. Further, the character data and the line data of the line are read out from the V-RAM 24 in accordance with the line number by the controller 26. Then based on the character data, the line data, and a current value 0 of the vertical operation counter, the controller 26 provides the character number of a character to be displayed on the display dot 0 in the row $VL_0$ (on the pixel $P_{0,0}$ of FIG. 18) and the pixel position (a position in FIG. 8 to which the pixel corresponds) to an address generator 32. Upon receipt of both the character number and the pixel position, the address generator 32 provides an address to the character ROM 28 and then a pattern data corresponding to the address is outputted from the character ROM 28. The pattern data thus outputted are converted into 4-bit pixel data by a dot data extract circuit 34 and the converted data are then provided to a palette controller 36. The palette controller 36 comprises a buffer $LB_1$ (hereinafter referred to as the first buffer $LB_1$) and a buffer $LB_2$ (hereinafter referred to as the second buffer $LB_2$) as shown in FIG. 20. The 4-bit data provided to the palette controller 36 are stored in the first buffer $LB_1$.

Next, the controller 26 reads out the line number 1 stored in the storing segment 1 of the display table. Also, the individual character data and line data of the line are read out from the V-RAM 24 in accordance with the line number read out by the controller 26.

Then, based on the individual character data, the line data, and the current value 0 of the vertical operation counter, the controller 26 provides the character number of a character to be displayed on the display dot 1 in the row $VL_0$ (on the pixel $P_{0,1}$ of FIG. 18) and the pixel position (a position in FIG. 8 which the pixel corresponds to) to address generator 32. Upon receipt of both the character number and the pixel position, the address generator 32 provides an address to the character ROM 28 and then a pattern data corresponding to the address is outputted from the character ROM 28. The pattern data thus outputted is converted into 4-bit pixel data by the dot data extract circuit 34 and the data are then provided to the palette controller 36. The 4-bit dta provided to the palette controller 36 are stored in the first buffer $LB_1$.

The above-described operation is carried out repeatedly to the display dot 463. Thus, pixel data for one row (the row $VL_0$) from pixel $P_{0,0}$ to $P_{0,463}$ are stored in the first line buffer $LB_1$ of the palette controller 36.

While the controller 26 carries out the above described operation, the palette controller 36 outputs pixel data for the lowermost row of the display screen which are already stored in the second line buffer $LB_2$. Upon receipt of the pixel data, the palette controller 36 outputs sequentially the pixel data from the display dot 0. At that time, a color palette number (see FIG. 9) correspondent to the character stored in the V-RAM 24 is added to the pixel data. Thus, the data are outputted as 12-bit data. The color palette 38 receives the 12-bit data, and the color palette 38 outputs color data to an analog converter 40. Thus, video signals of R, G. B for the previous row are obtained.

As described above, it is possible to store the pixel data for the row $VL_0$ of the active area α in the first line buffer $LB_1$, while the video signals of the previous row stored in the second line buffer $LB_2$ are obtained.

Thus, on completion of the above-described operation, the pixel data for the first row $VL_1$ (the row next to the row $VL_0$) of the active area α are stored in the second line buffer $LB_2$, and the video signals are obtained based on the pixel data for the row $VL_0$ stored in the first line buffer $LB_1$. Before the above operation, the controller 26 clears the display table, then increments the value of the vertical operation counter to 1. R, G, B video signals of the active area α are obtained by carrying out the above-described operation for the second row VL2 to the 255th row $VL_{255}$ sequentially.

Upon completion of all the operations for the 256 rows, the controller 26 clears the value of the vertical operation counter to 0, and the controller 26 then carries out the operation described above from the row $VL_0$. Thereafter, images displayed on the display screen are renewed by carrying out all of the above described operations. The reason for using both the first line buffer $LB_1$ and the second line buffer $LB_2$ is to the increase speed of the operation.

On the 26th row $VL_{26}$ of the active area α, characters of the line 2 and characters of the line 32 are partially overlapped (pixel $P_{26,26}$ to pixel $P_{26,41}$ as shown in FIG. 18). In that case, the controller 26 carries out the operation successively in order of line 1, line 2, line 3 . . . . Data in the display table is generated as shown in FIG. 19 A when the controller 26 completes the operation until line 29. The line 30 is not displayed because the number of active characters in the line 30 is specified as 0, as shown in FIG. 17. Also, since line 31 is not displayed in the 26th row VL26 as shown in FIG. 18, the data of the line 31 are not stored in the display table.

Next, the controller 26 determines that line 32 must be displayed on the 26th row. The line number 32 is stored in the storing segment 26 to 41 of the display table as shown in FIG. 19 B. By storing the line number 32, line numbers 2 and 3 stored originally are erased.

Thus, the larger line number a line sprite has, the higher display priority it has. In other words, line 380 has the highest priority in this embodiment. The characters of line 32 are displayed on the characters of line 2 and line 3. That is, the part of the background (the characters of line 2 and line 3) which is overlapped by characters of line 32 is not displayed on the display screen.

ROM 30 stores data for omission which specify the pixels to be omitted in shrinking based on a number specified in the region of vertical shrinkage shown in FIG. 10. The controller 26 omits the pixel data of either row or column in accordance with the data for data omission.

Figure 21:
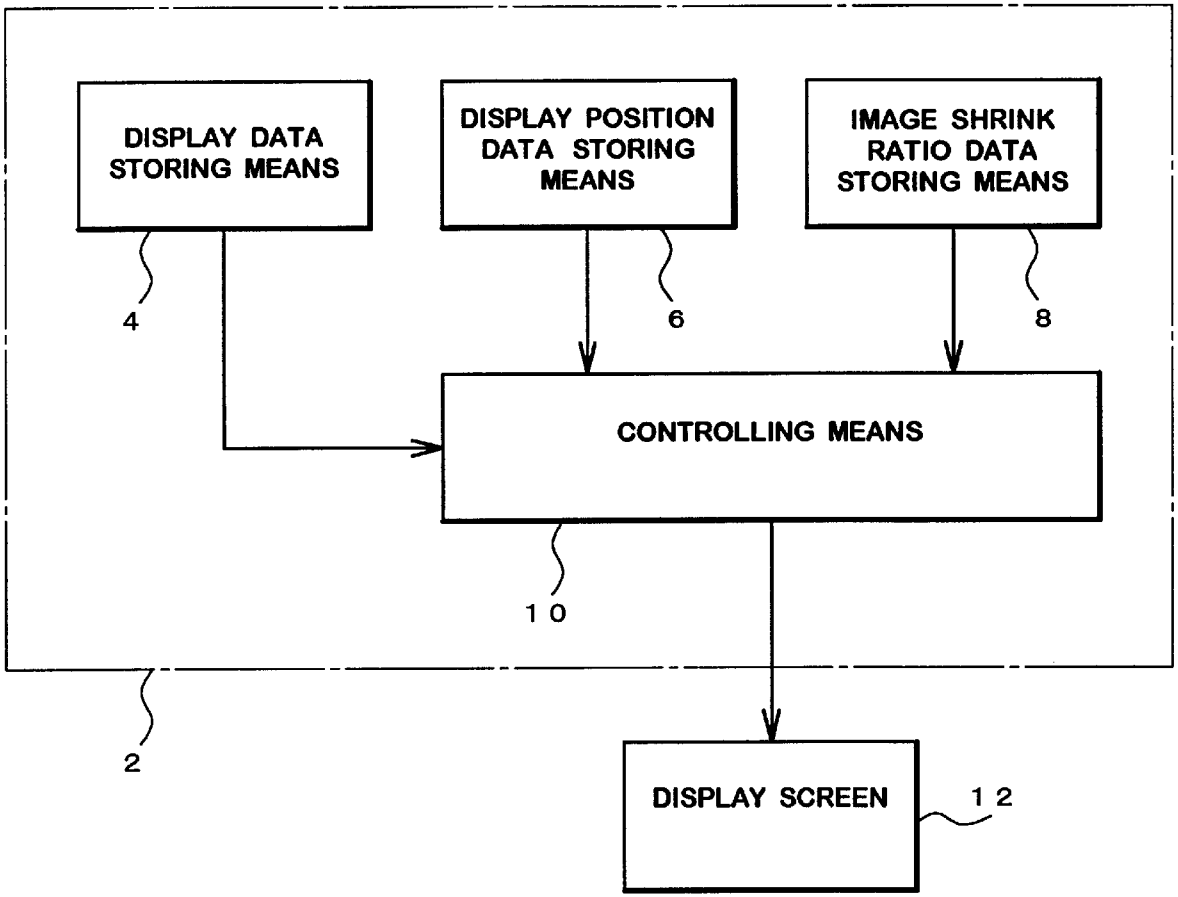
FIG. 21 is a view illustrating a structure of a display control apparatus 2 in another embodiment of the present invention.

FIG. 21 shows a display control apparatus 2 according to another embodiment of the present invention. The display control apparatus 2 is an apparatus for displaying a rotating object having three dimensions and comprises a display data storing unit 4, a display position data storing unit 6, an image shrink ratio data storing unit 8 and a controlling unit 10.

The display data storing unit 4 stores display data corresponding to each of the divided regions obtained by dividing the surface of a three-dimensional (3-D) object into a plurality of regions. Also, the display position data storing unit 6 stores display position data for each of the divided regions being varied in accordance with rotation of the 3-D object. The image shrink ratio data storing unit 8 stores image shrink ratio data provided in accordance with a rotating position of each of the divided regions. Further the controlling unit 10 controls the units to display or not to display the whole or part of the display data for each of the divided regions on the display screen 12 in accordance with the display position data and the image shrink ratio data of each of the divided regions.

The description of FIG. 5 to FIG. 10 in the previous embodiment can be applied to the embodiment described hereunder.

The V-RAM 24 shown in FIG. 6 corresponds to part of the display data storing unit 4, the display position storing unit 6 and the image shrink ratio data storing unit 8 shown in FIG. 21. Also, character ROM 28 corresponds to part of the display data storing unit 4 shown in FIG. 21. Further, the CRT 44 is equivalent to a display screen 12 of FIG. 21. Also, the vertical position and the horizontal position shown in FIG. 10 correspond to display position data.

Figure 22:
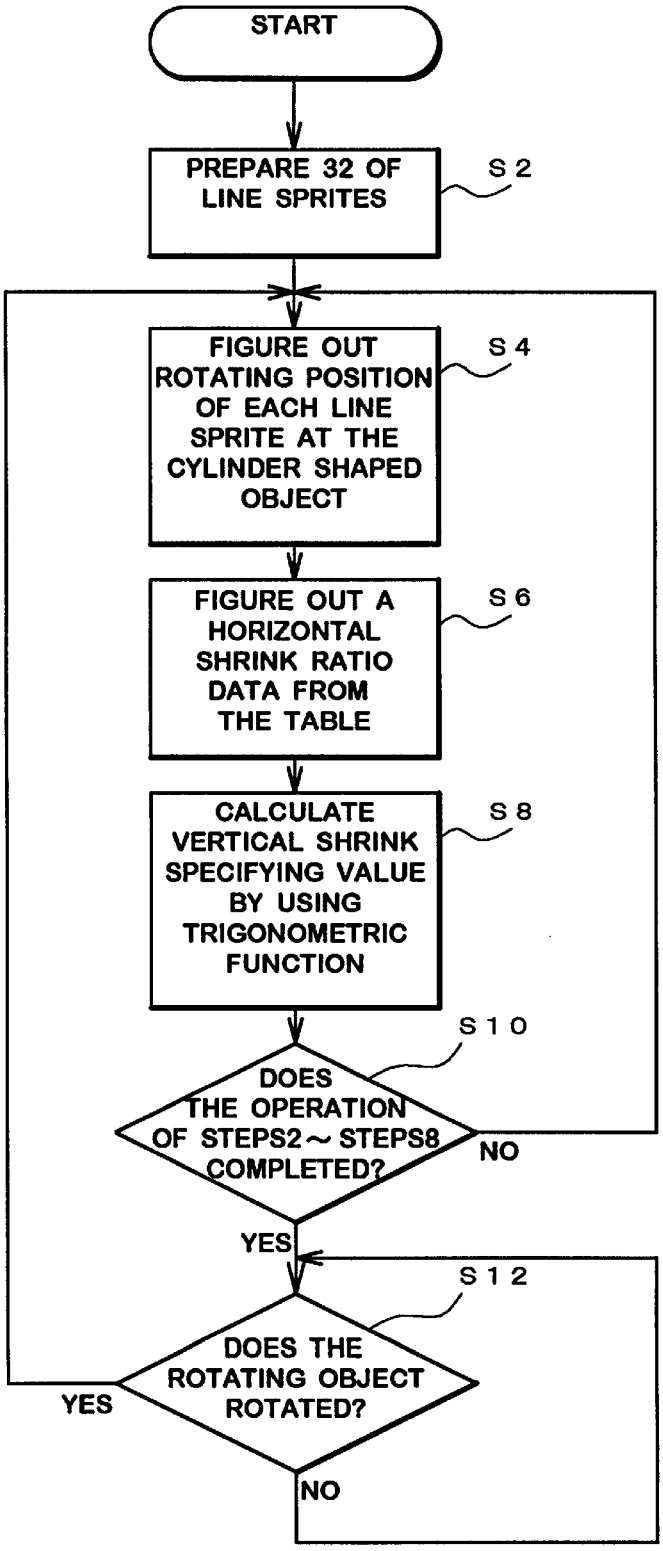
FIG. 22 is a flow chart illustrating steps for displaying the earth in rotation.

Operation for displaying the earth (a sphere) as a rotating 3-D object and for displaying an object such as a person using the rotating earth as a background by utilizing the display controlling circuit 18 will be described. First of all, an operating procedure for displaying the rotating earth is described based on FIG. 22 and FIG. 23.

Figure 23:
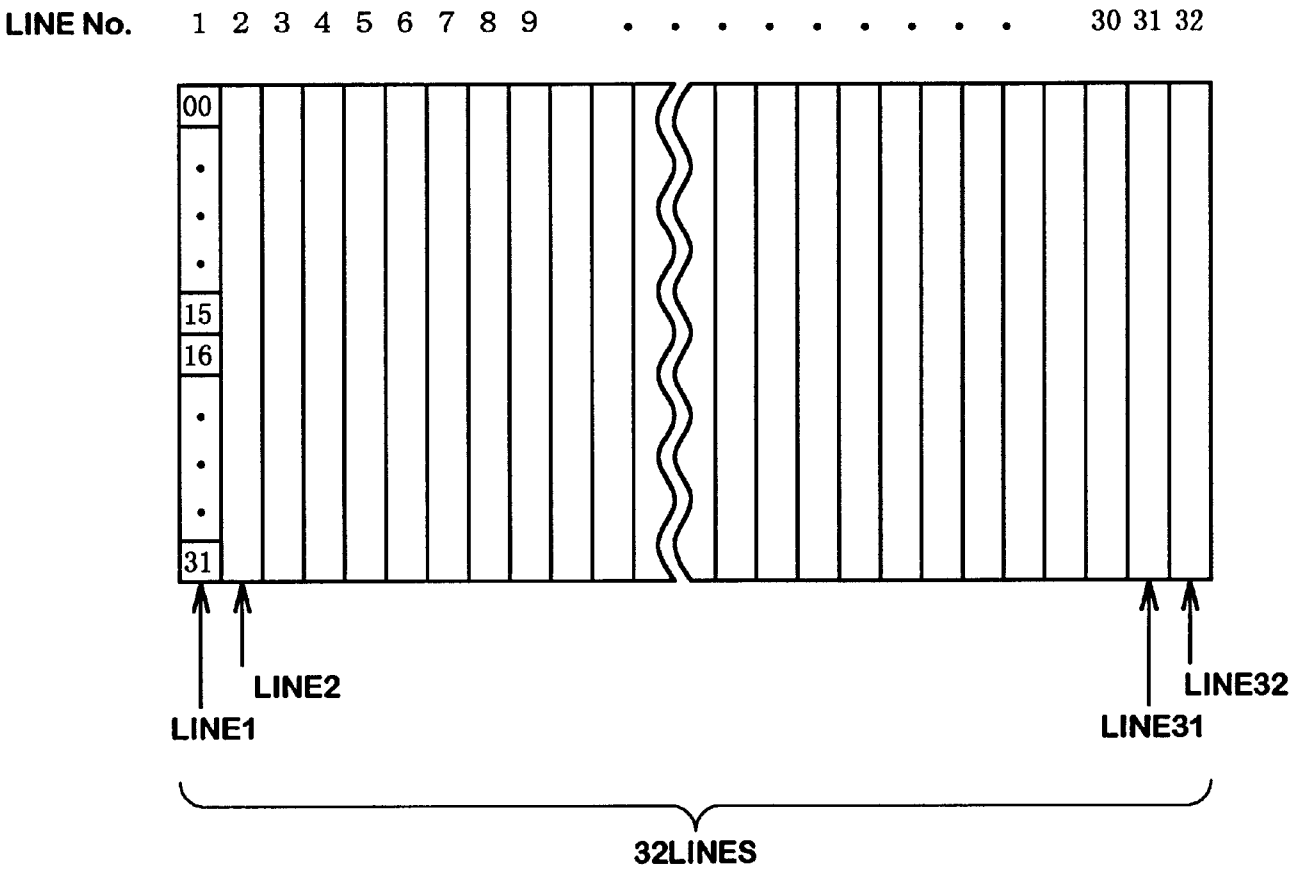
FIG. 23 is a conceptual view illustrating line sprites for displaying the earth in rotation laid on a plane.

Initially, a total of 32 line sprites are prepared to display the earth (step S2, see FIG. 23). The 32 line sprites are generated by the following procedures. In this embodiment, a total of 512 blocks (squares) obtained by dividing a map of the earth drawn with Mercator projection (the aspect ratio of 1:2) into 32 blocks in the horizontal direction (east-west) and 16 blocks in vertical the direction (south-north) are stored in the character ROM 28 as display blocks.

The processor 20 writes data into the V-RAM 24 to make the upper half of the line sprite 1 (line sprite 1) at the west end of the map using 16 blocks in the vertical direction. No data are written for the lower half of the line 1. To prevent meaningless operation to the lower half of the line 1, the number of active characters (see FIG. 10) is specified as 16. In the same way, each character and the number of active characters are specified for each of the line 2 to line 32. Thus, a total of 32 line sprites are prepared. In other words, the surface of the earth is represented by 32 divided regions. Part of the chart specified with each of the line sprites corresponds to the display data.

Next, the 32 line sprites are used to generate a make-believe cylinder which has its axis in the longitudinal direction of the line sprites. Then, a display position, that is, a rotating position of each line sprite is figured out (step S4).

In this embodiment, the rotating positions provide display positions of each of the line sprites on the display screen with respect to the rotating axis of the cylinder.

Figure 24:
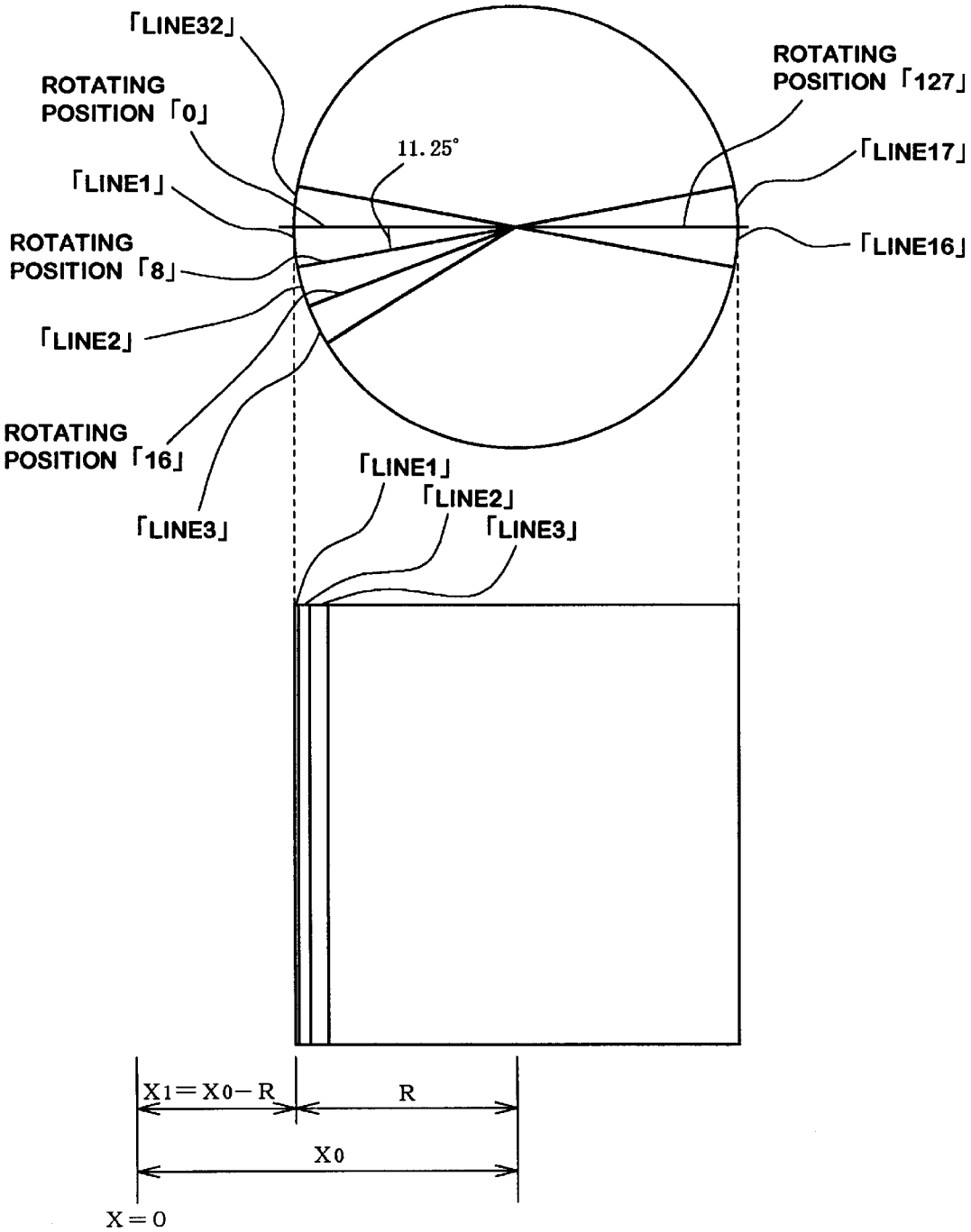
FIG. 24 is a conceptual view illustrating line sprites for displaying the earth in rotation provided in a cylinder shape.

Assuming, the circumference of the cylinder is equally divided into 256 segments to obtain rotating positions. One unit of the rotating position can be calculated by 360°/256, that is, 1.40625°: On the other hand, the central angle made by one line sprite can be calculated by 360°/32, that is, 11.25° (FIG. 24). A rotating position of a line sprite is apart circumferentially by 8 units from its adjacent line sprite. In other words, assuming that line 1 is the first rotating position and its rotating position is T1, a rotating position Tn of the nth line is calculated by the following equation.

$$Tn=T1+8\ (n-1)$$

Therefore, rotating position T3 of line 2 and rotating position T3 of line 3 are respectively 8 and 16 when assuming the rotating position T1 of line 1 is 0 (FIG. 24).

Next, a horizontal shrink specifying value as an image shrink ratio of the horizontal (X) direction for line n is figured out (step S6). As shown in FIG. 24, line 2 and line 3 are considerably shrunk in the horizontal direction when observing the cylinder toward the front. A horizontal shrink specifying value provides an image shrink ratio in the horizontal direction for each line sprite. A cylinder-shaped object can be displayed on the display screen by providing an appropriate horizontal shrink specifying value to each of the line sprites.

FIG. 25 shows a correspondence table describing a relationship between rotating positions of line sprites and horizontal shrink specifying values. The correspondence table is stored in the ROM 16 (see FIG. 7) which stores game programs. A horizontal shrink specifying value of line n is calculated in accordance with the correspondence table and with the rotating position Tn of the line n. According to the correspondence table, a horizontal shrink specifying value corresponding to the rotating position 0 equals to 1. It is understood that the horizontal shrink specifying value of line 1 in FIG. 24 is 1. In the same way, the horizontal shrink specifying values of line 1 and line 3 are figured out as 3 and 7 respectively. Then the processor 20 writes the horizontal shrink specifying value of line n into the horizontal shrink region of the V-RAM 24 (see FIG. 10). Although there are 256 rotating positions of the cylinder, 128 columns are enough to provide the correspondence table shown in FIG 25, because exactly the same image shrink ratios can be used for the rear side of the cylinder. Meanwhile, it is possible to figure out a horizontal shrink specifying value by utilizing trigonometric functions. In the step S6, horizontal coordinates of the line sprites in the active area α are also calculated in addition to the horizontal shrink specifying value. The horizontal coordinate Xn of line n is calculated by the following equation assuming X0 as the horizontal coordinate of the cylinder center in the active area α (see FIG. 26), and R as the radius of the cylinder.

$$Xn=X0-R\times Cos\ (1.40625^{\circ}\times Tn)$$

The horizontal coordinate of line 1 in FIG. 24 can be calculated by the following equation X1=X0−R. Then the calculated value of horizontal position region (see FIG. 10) by the processor 20. In this embodiment, values of trigonometric functions are previously stored in a ROM (not shown) for the system operation in the form of a numeric table.

Figure 26:
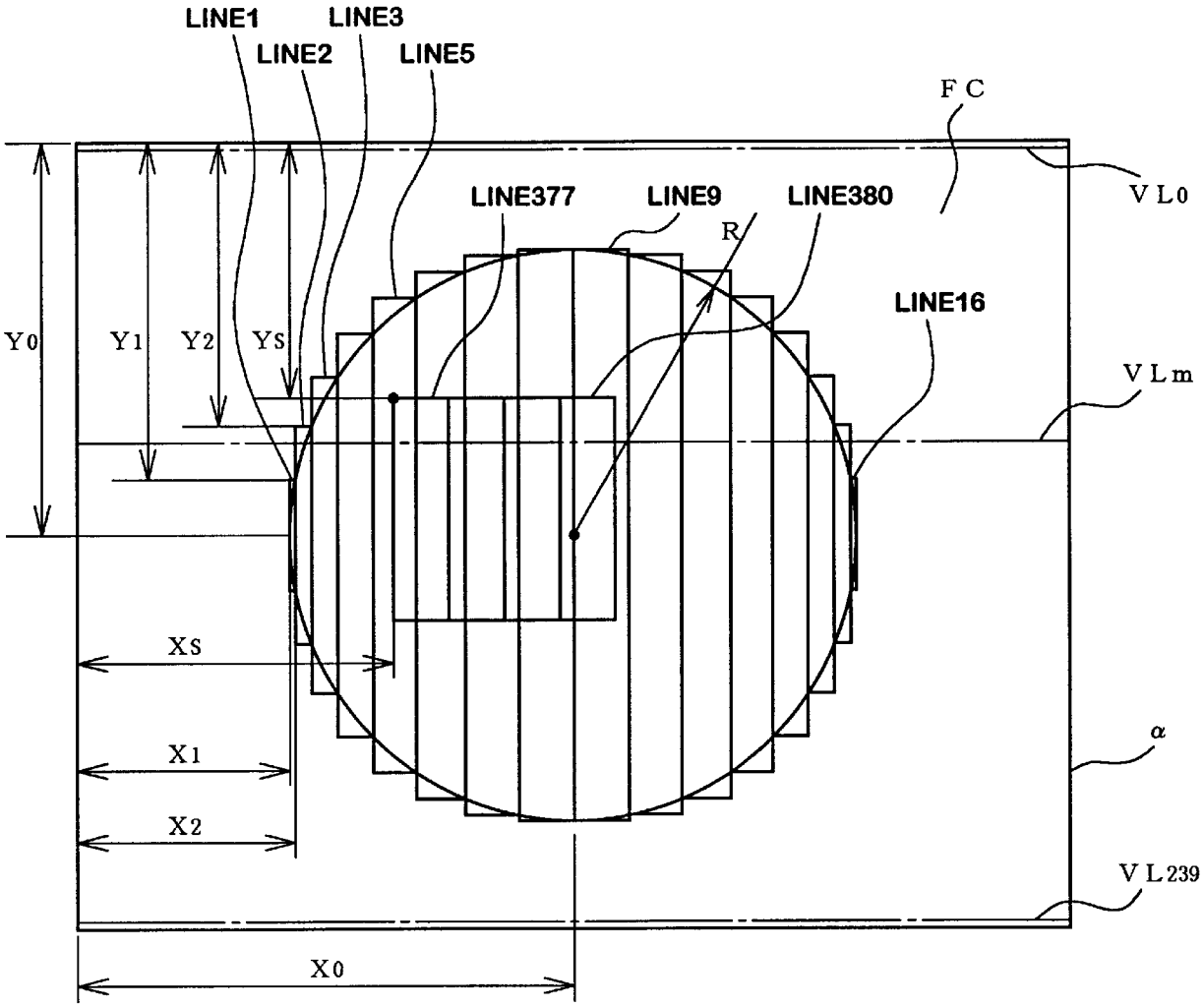
FIG. 26 is a view for illustrating a display of a person and the earth consisting of line sprites and for describing an operation of the controller 26.

A spherical object with a radius R as shown in FIG. 26 can be displayed by providing a certain shrink value in the vertical direction as described below to each of the line sprites which forms the cylinder shown in FIG. 24.

The processor 20 calculates a vertical shrink specifying value as an image shrink ratio of line n in the vertical direction (step S8). Thus, a spherical object can be displayed on the display screen by vertically shrinking each of the line sprites which form the cylinder.

Vertical shrink specifying value Vn is calculated by using a trigonometric function in accordance with the above described rotating position Tn of the line sprite:

$$Vn=128\times(1+|Sin\ (1.40625^{\circ}\times Tn)|)-1$$

The vertical shrink specifying value V1 of line 1 in FIG. 26 is figured out by the following equation.

$$V1=128\ (1+|Sin\ (1.4062^{\circ}\times 0)|)-1=127$$

In the same way, the vertical shrink specifying values of line 2 and line 3 in FIG. 26 are calculated 152 and 176 respectively. On completion of these calculations, the processor 20 writes the vertical shrink specifying value Vn in the vertical shrink region of the V-RAM 24. The vertical shrink specifying values can be figured out in accordance with a correspondence table which indicates a relationship between rotating positions of the line sprites and vertical shrink specifying values.

In this embodiment, the ROM 16 which stores game programs as described above and the processor 20 correspond to an image shrink ratio output means.

In the step S8, vertical coordinates of each line sprite in the active area α are also calculated in addition to the vertical shrink specifying values. The vertical coordinate Yn of line n is calculated by the following equation assuming Y0 as the vertical coordinate of the center of the sphere in the active area α and R as the radius of the sphere $$Yn=Y0-R\times(Vn+1)/256$$

Vertical coordinate Y1 of line 1 in FIG. 26 is calculated Y1=Y0−0.5 R.

Then the processor 20 writes the calculated value of the vertical coordinate Yn of line n in the vertical position region of the V-RAM 24 (see FIG. 10). In this embodiment, values of a trigonometric function for the above-described calculations are stored in a ROM (not shown) for the system in the form of a numeric table.

Thus, the processor 20 carries out the above-described operations to all the line sprites (step S10). Also, the processor 20 does not display the rear side of the earth by specifying the number of active characters (see FIG. 10) as 0 to the line sprites whose rotating positions Tn are equal to or greater than 128. As a result of the control, line 17 to line 32 are not displayed on the display screen.

Figure 27:
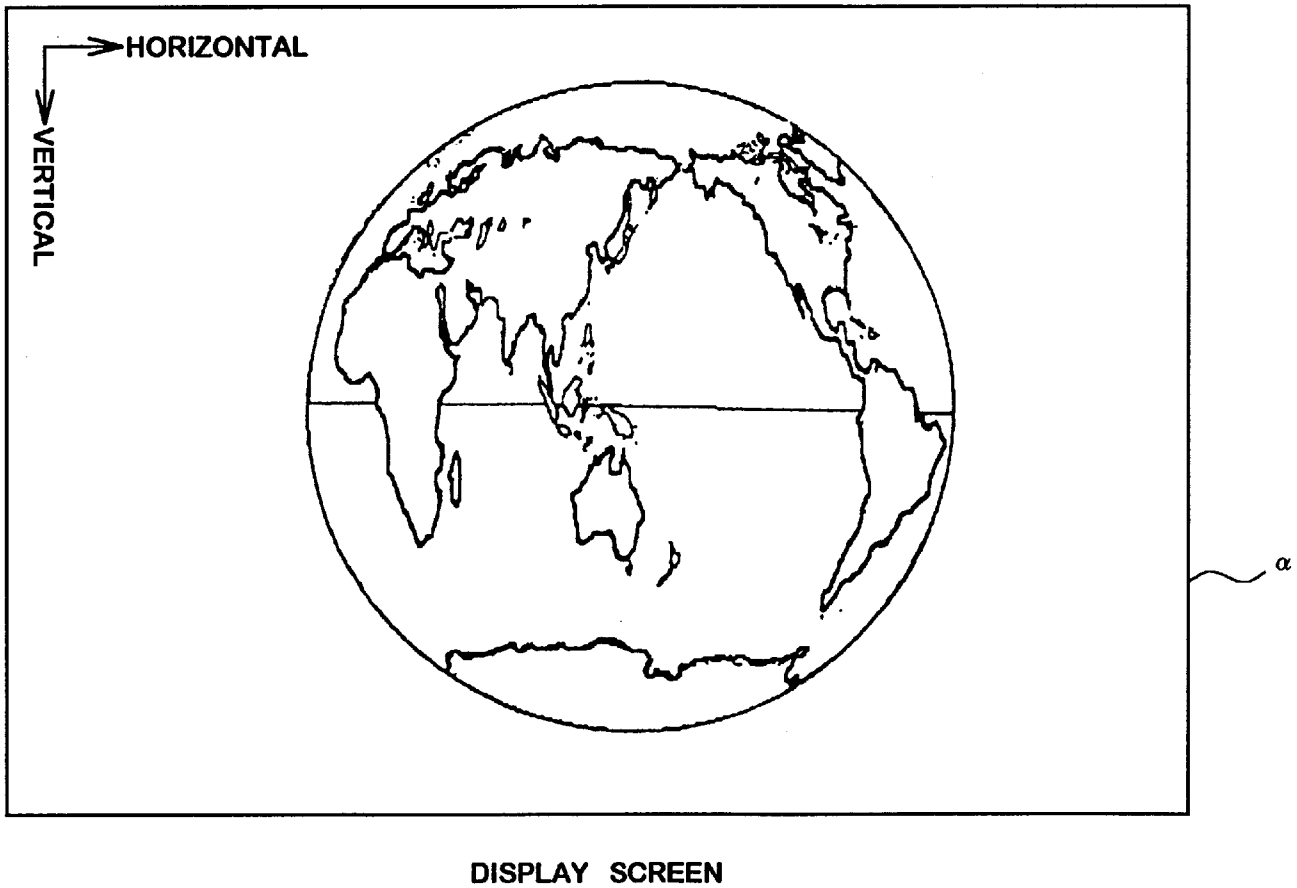
FIG. 27 is a view illustrating a display of the earth in rotation on the display screen.

Thus, line 1 to line 16 shrunk horizontally and vertically are displayed on the CRT 44 in steps. However it is possible to display the earth having a smooth circumference by masking the step-edge earth with a fixed pattern FC, not shown, which has a circular opening (FIG. 27).

Since the fixed character FC has the highest display priority, it is preferable to use the fixed pattern FC as a mask.

It is possible to rotate the earth on the display screen by changing the rotating positions of line 1 to line 32 successively and then by carrying out the operations of step S4 to step S10 at every change of the rotating positions (step S12). For instance, the earth seems to rotate from the west to the east by applying the operations in steps S4 to S10 to Tn (n=0, 1, 2, 3, . . . ).

Figure 28:
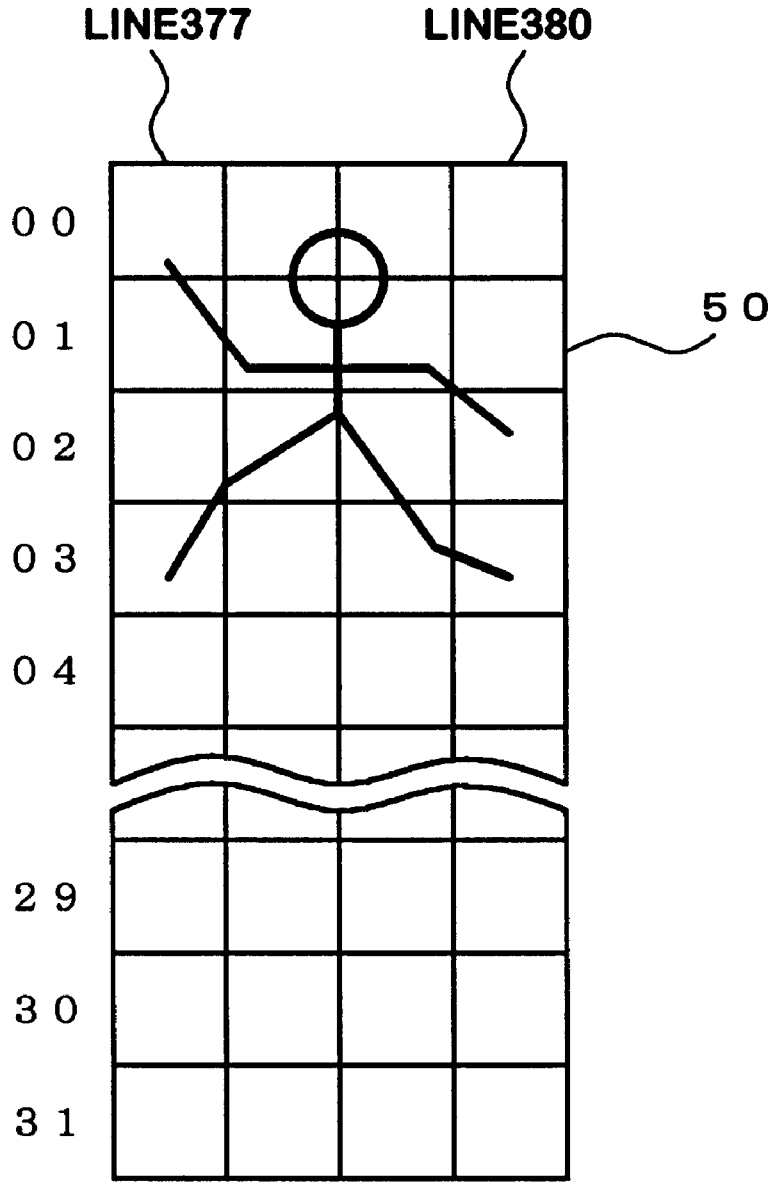
FIG. 28 is a view illustrating a display of a person using line sprites.

Next, the operation for display of an object such as a person using the rotating earth as a background will be described. Initially, a person is generated by specifying characters of line 377 to line 380 as shown in FIG. 28. The chain bits (see FIG. 10) of line 378 to line 380 are specified as 1. By doing that, once the display position of line 377 is specified, display positions of line 378 to line 380 are automatically determined. Also, the number of the active characters (see FIG. 10) for each of the lines which make up the person is specified as 4. Thus, the object 50 consisting of 64 pixels in the vertical direction and 64 pixels in the horizontal direction can be specified. A vertical position and a horizontal position of the object 50 on the display screen are determined and specified by the game programs executed on the processor 20.

FIG. 29 shows line data as an example of the data written in the V-RAM 24 of this embodiment (the character data illustrated in FIG. 5 are not shown). Operation of the controller 26 will be described below. FIG. 26 shows a conceptual view illustrating a relationship between line data stored in the V-RAM 24, and positions of the active area α. First of all, the controller 26 resets an internal vertical operation counter (not shown) to 0. A value of the vertical operation counter indicates a vertical position for which the controller 26 operates. Operation is carried out to the uppermost row VL0 of the active area α as shown in FIG. 26 when the value of the vertical operation counter is 0. In this embodiment, it is assumed that the active area α consists of 240 pixels in the vertical direction and 320 pixels in the horizontal direction. The operation is carried out successively for a total of 240 rows from the row VL0 to the 239th row VL239.

It is assumed that the vertical operation counter is set to m, and that the mth row VLm is under execution. The controller 26 judges whether a line sprite must be displayed on the mth row VLm or not in accordance with line data of the line sprite. First of all, the controller 26 judges that line 1 must not be displayed on the mth row VLm in accordance with the vertical position and the number of active characters in the line data of line 1 (see FIG. 29).

In that case, line 1 is not stored in a display table (see FIG. 30) made of an internal work RAM (not shown). In this embodiment, number 1 to number 96 are prepared as addresses of the work RAM unlike the display tables shown in FIG. 19A and FIG. 19B. The display table consisting of the address has a different structure from the display table described in the previous embodiment (see FIG. 19A and FIG. 19B). That is, up to 96 line sprites which must be displayed in the active area α can be stored in the work RAM.

Next, the controller 26 determines whether line 2 must be displayed on the mth row VLm or not. The controller 26 judges that line 2 must be displayed on the mth row VLm, a value of 2 is written in the address 1 of the work RAM to show that line 2 must be displayed.

In the same way, the controller 26 judges whether each of the lines including line 380 must be displayed on the mth row VLm or not. The line numbers of lines which must be displayed on the mth row VLm are stored in the display table. For instance, a decision is made that line 377, line 378, line 379 and line 380 must be displayed on the mth row VLm. Because the numbers of active characters of line 17 to line 32 shown in FIG. 26 are all 0 (see FIG. 29), these line numbers are not stored in the display table.

Figure 30:
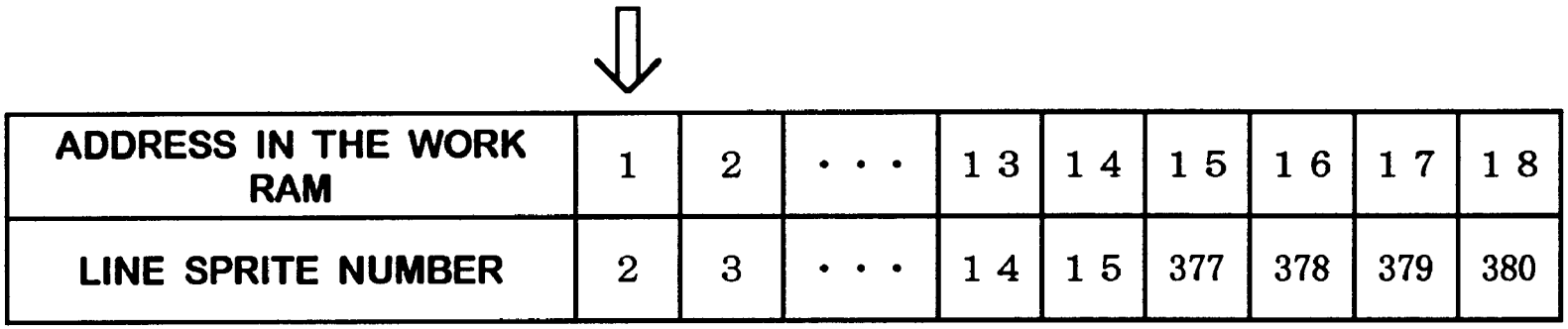
FIG. 30 is a view illustrating a display table in the controller 26.

FIG. 30 shows a display table in respect to the mth row VLm generated as described above. The controller 26 carries out display operation as follows in accordance with the display table thus generated.

Figure 31:
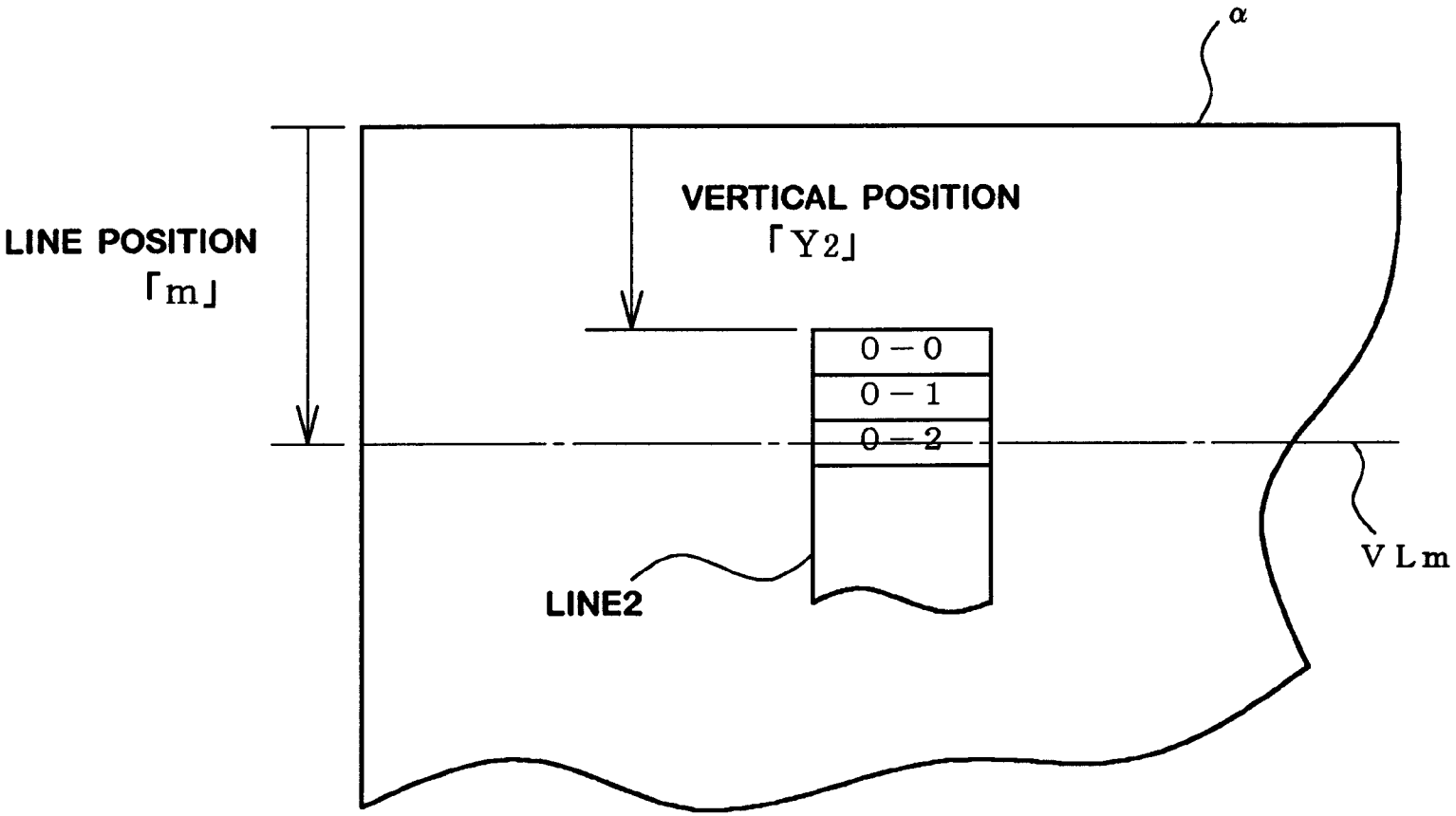
FIG. 31 is a view illustrating steps for obtaining a character position and raster number of the line which to be executed.

First of all, line number 2 stored in address 1 of the display table shown in FIG. 30 is read out by the controller 26. Further to that, the individual character data (see FIG. 9) of the line and the line data (see FIG. 29) are read out from the V-RAM 24. As shown in FIG. 31, the controller 26 recognizes both a character position of the line to be executed (a character position in FIG. 11A) and a raster number of the character (a raster number in FIG. 8) in accordance with a difference between a current value m (line position) of the vertical operation counter and a vertical position Y2 in the line data read out from the V-RAM 24. In FIG. 31, it is understood that the character position 0 and the raster number 2 are under current execution.

On the other hand, the tables shown in FIG. 32 to FIG. 34 are stored in the ROM 30 for shrink data (hereinafter referred to as shrink data ROM 30). FIG. 32 shows a table which gives shrink display patterns the in the vertical direction when the vertical shrink specifying value is equal to 0, that is, the image shrink ratio in the vertical direction is 1/256. Also, FIG. 33 and FIG. 34 show tables which give a plurality of shrink display patterns in the vertical direction. FIG. 33 is a table indicating shrink display patterns when a vertical shrink specifying value equals 7F (127), that is, an image shrink ratio in the vertical direction is 0.5 as the result of the calculation of 128/256. FIG. 34 is a table indicating a plurality of shrink display patterns when a vertical shrink specifying value is equal to FF (255), that is, an image shrink ratio in the vertical direction is 1 as the result of the calculation of 256/256. A total of 256 tables corresponding to the image shrink ratios in the vertical direction are stored in the shrink data ROM 30.

In FIG. 33, for example, a vertical shrink specifying value of the line is represented by the 2 leftmost digits (7F) in the address made of 4 digits in the hexadecimal system. The left digit of the rightmost digits represents a character position which is currently executed, and the right digit indicates a raster number which is to be displayed. Address 7F02 is specified by vertical shrink specifying value 7F (127) read out from the V-RAM 24, the character position, and the raster number to be executed currently (see FIG. 33). Then, data 04 is read out from address 7F02. A character position to be displayed is represented by the left digit of the read-out data, and the right digit indicates a raster number to be displayed.

Figure 35:
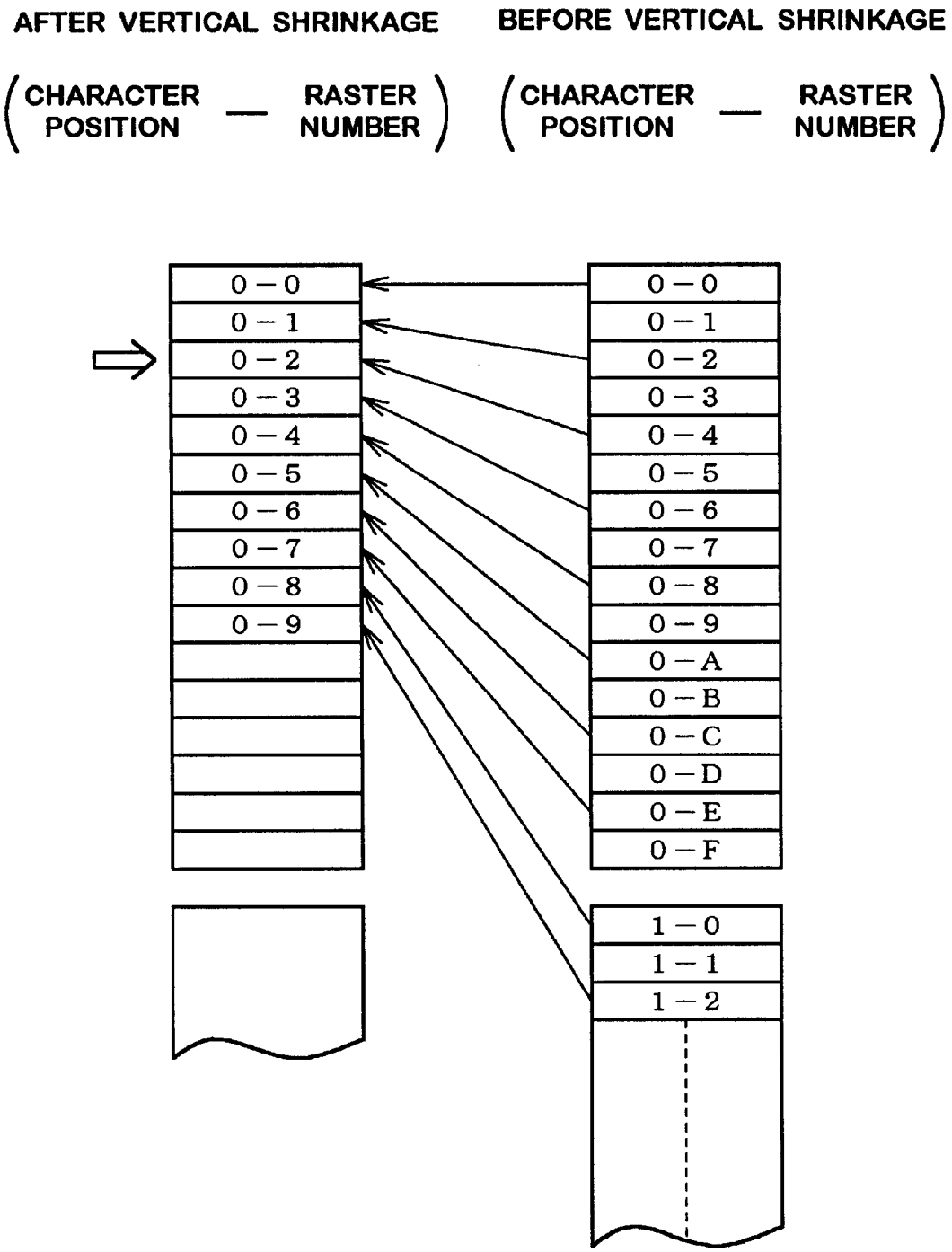
FIG. 35 is a view illustrating character positions and raster numbers before and after carrying out vertical shrinkage.

Therefore, as shown in FIG. 35, after vertical shrinkage, data specified by the character position 0 and raster number 4 are displayed at the position specified by the character position 0 and the raster number 2.

Thus, character positions and raster numbers to be displayed on the mth row VLm (see FIG. 26) can be obtained by referring to the shrink data ROM 30. In FIG. 32 and FIG. 33, output data FF indicates that display operation is not executed.

Figure 36:
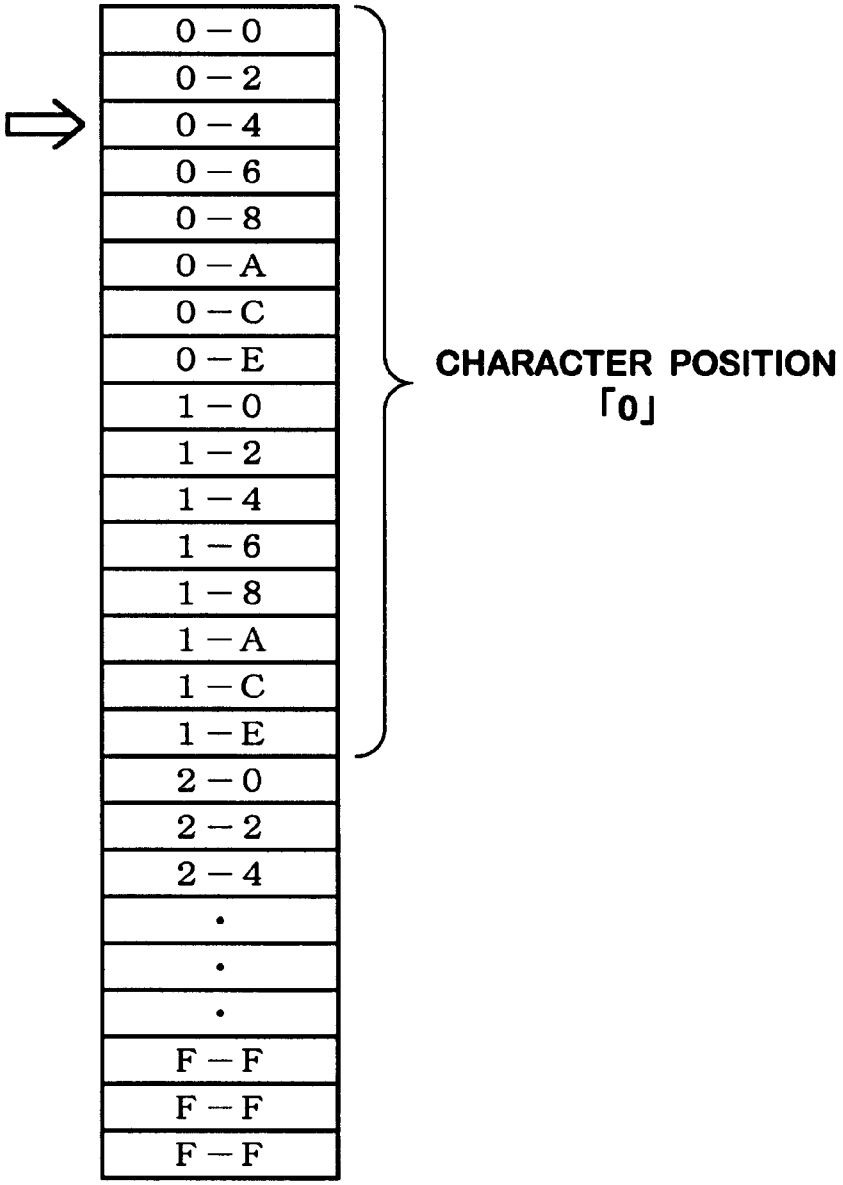
FIG. 36 is a view illustrating a display pattern after carrying out vertical shrinkage.

Next, the controller 26, following the display pattern after vertical shrinkage (FIG. 36), provides the character number (the character number stored in the region of C2,0) and raster number 4 corresponding to character position 0 in accordance with the individual character data (see FIG. 9) of the line to the address generator 32. On receipt of the character number and the raster number, the address generator 32 sends an address to the character ROM 28 to read out 16-pixel data (4 bits per pixel). The 16-pixel data is divided into 2 blocks of 8-pixel data and outputted from the character ROM 28 in parallel.

The 16-pixel data outputted from the character ROM 28 is converted into serial data by the dot data extract circuit 34 and then the converted data are provided to the palette controller 36.

Figure 38:
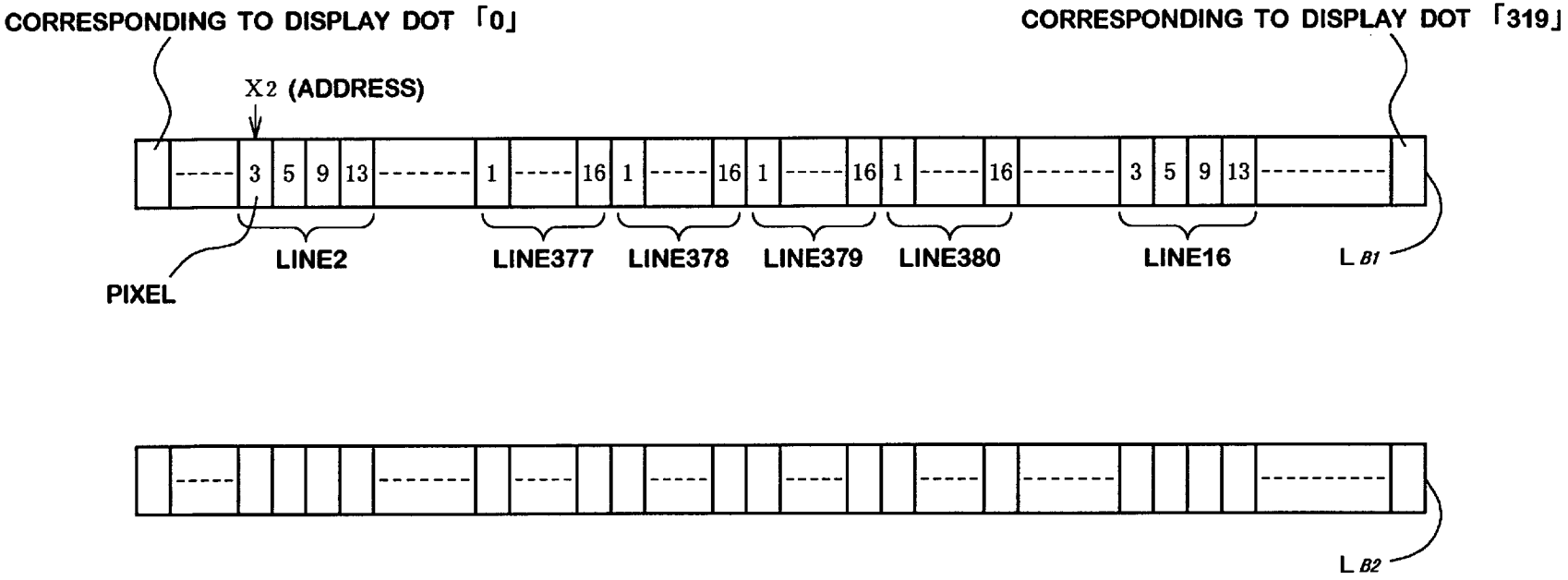
FIG. 38 is a view illustrating a data structure of the line buffer $LB_1$ and the line buffer $LB_2$.

As shown in FIG. 38, palette controller 36 has 2 line buffers, the first buffer LB1 and LB2 the second line buffer. Both the first line buffer LB1 and the second line buffer LB2 consist of 320 columns (4 bits per 1 column) to store the pixel data for one raster of the active area α. The palette controller 36 sends 16 serial data (each data consists of 4 bits for one pixel) to the first line buffer LB1 successively.

Because the horizontal shrink specifying value of line 2 is 3 (FIG. 29), the controller deletes 12 pixel data from the 16 pixel data sent to the first line buffer LB1 in accordance with the table shown in FIG. 37. The remaining 4 pixel data such as the 3rd, the 5th the 9th and the 13th data are stored next to each other in the line buffer LB1 (see FIG. 38). The head address of these 4 pixels in the first line buffer LB1 is the horizontal position X2 of the line data (see FIG. 29).

The table shown in FIG. 37 for outputting shrink display patterns in the horizontal direction in accordance with a horizontal shrink specifying value is made of a hardware logic installed in the controller 26 in this embodiment. Shrinkage in horizontal direction is carried out using the hardware-logic table. In this embodiment, the shrink data ROM 30 and the controller 26 correspond to a display pattern outputting means.

The operations described above are carried out a total of 18 times successively from the smallest-number line sprite to the largest-number sprite in order. Thus, the pixel data for one row to be displayed on the mth row VLm (FIG. 26) are stored in the first line buffer LB1 of the palette controller 36 as shown in FIG. 38.

As shown in FIG. 26, line 5 to line 9 and line 377 to line 380 overlap each other. The controller 26 carries out the operation in the order of line 1, line 2, line 3 . . . as described above. Although the data for line 5 to line 9 are stored in first line buffer LB1 when completing the operation to line 15, the data are erased from the buffer by storing the data for line 377 to line 380 (see FIG. 38).

Thus, the larger line number a line sprite has, the higher display priority it has. Line 380 has the highest display priority. Line 377 to line 380 are displayed on line 5 to line 9. In other words, the part of line 5 to line 9 behind line 377 to line 380 is not displayed.

While the controller 26 carries out the above-described operations, the palette controller 36 outputs the pixel data of the previous row (the row VLm—1) which is already stored in the second line buffer LB2. That is, the palette controller 36 outputs the pixel data beginning with the display dot 0 in order. At that time, the color palette number (8 bits data, see FIG. 9) stored correspondently with the pixel data in the V-RAM 24 is added to the pixel data. Thus, 12 bit data are generated by the palette controller 36.

Further, the palette controller 36 combines the data thus generated with the data stored in a ROW for fixed character (FIX character ROM, not shown) and then outputs it to the color palette 38. As described above, the fixed character FC has the highest display priority.

The color palette 38 receives the combined data, and outputs color data to the analog converter 40. Thus, the video signals of R, G, B for the previous row are obtained.

As described above, it is possible to store the pixel data for the mth row VLm of the active area α into the first buffer LB1 and to obtain video signals of the previous row stored in the second line buffer LB2.

Thus, on completion of the above-described operations, the controller 26 clears the display table and then increments the value of the vertical operation counter to m+1. Then the controller 26 stores the pixel data for the m+1th row VLm+1 of the active area α in the second line buffer LB2, and obtains the video signals based on the pixel data of the mth row stored in the line buffer LB1. R, G, B video signals for the active area α are obtained by carrying out the above-described operation for the m+2th row and to the 240th row sequentially.

Upon completion of all the operation for 240 rows, the controller 26 clears the value of the vertical operation counter to 0, and then the controller 26 carries out the operations described above from the row VL0. Thereafter, images displayed on the display screen are updated by carrying out all the above-described operations. The reason for using both the first line buffer LB1 and the second line buffer LB2 is to increase speed of the operation.

In the embodiment described above, the shrink data ROM 30 and the controller 26 are used as the shrink and enlargement display pattern outputting means. The shrink display patterns in the vertical direction are outputted form the shrink data ROM 30, and the shrink display patterns in the horizontal direction are outputted in accordance with the hardware logic of the controller 26. However, it is possible for the controller 26 to have the hardware logic for outputting the shrink display patterns in the vertical direction and the shrink display patterns in horizontal direction can be outputted from the shrink data ROM. Also, it is possible to design the hardware logic of the controller 26 to output the shrink display patterns in both vertical and horizontal directions. The shrink data ROM 30 can store the vertical and horizontal shrink display patterns. Further, instead of the shrink data ROM 30 and, the controller 26, other devices can be used as the display pattern outputting means.

The ROM 16 storing the game programs and the processor 20 are used as the image size data outputting means, the image shrink ratios in the horizontal direction are outputted from the ROM 16, and the image shrink ratios in the vertical direction are calculated by the processor 20. However, it is possible to calculate the image shrink ratios in the horizontal direction by the processor 20 and the image shrink ratios in the vertical direction can be outputted from the ROM 16. Also, the image shrink ratios in horizontal and vertical directions can be calculated by the processor 20. Also, both the image shrink ratios in horizontal and vertical directions can be outputted from the ROM 16. Further, instead of the ROM 16 and the processor 20, other devices can be used as the shrink data output means. In the above embodiment, the control display apparatus is designed not to display the rear side of the sphere by specifying the number of active characters as 0. However, it is possible to display the rear side of the sphere by specifying the number of active characters greater than 0.

Also, in the above embodiment an object such as a person using the rotating earth as a background is described as an example. However, it is also possible to display the rotating earth on a background consisting of line sprites. Also, a person can be displayed on the rotating earth.

Further, in the above embodiment, the horizontal positions and vertical positions of each line sprite for illustrating the earth are specified for each line sprite, it is possible to avoid complex operations by specifying only the positions of one line sprite and by setting the chain bits of the following line sprites to 1 when a rotating object is cylindrical.

In the above-described embodiment, though the line sprites are used as means for displaying each of the divided regions, the means for displaying each of the divided regions is not limited to the line sprite, other components can be utilized as the means for displaying each of the divided regions.

Although a sphere (the earth) is used as an example of a rotating object having three dimensions, other rotating objects such as an ellipsoid objects, a cylinder (column), a prism such as a regular prism, and a square prism, a pyramid such as a right pyramid, a cone such as a circular cone, and a polyhedron and other complex objects can be used for rotating objects in the present invention. Also, a plurality of rotating objects in the same shape or differently shaped objects can be displayed on the display screen.

In the above embodiment, the axis of rotation for the rotating object (rotating axis) is directed in the vertical direction of the display screen. The rotating axis of the rotating object can be directed in the horizontal direction of the display screen or be oblique to the horizontal direction. Also, each of the rotating axes of the rotating objects can be directed in the same direction or in different directions when a plurality of rotating objects are rotated on the display screen. Further, the rotating axis can be through the rotating object or can be out of the rotating object.

In the above-described embodiment, the characters directed sequentially in the vertical direction are treated as a line sprite. The characters directed sequentially in the horizontal direction can also be used as a line sprite. In that case, the chain bit represents a continuity of the line sprites in the vertical direction.

Although, an image shrink ratio is specified by the size specification means in the above embodiment, an image enlargement ratio can be specified by the size specification means. Further, both the image shrink ratio and the image enlargement ratio can be specified by the size specification means.

In the above-described embodiment, although the processor 20 controls the units in accordance with the programs stored in the ROM 16, other program storage devices such as a flexible disc, a hard disc, a CD-ROM an IC card, each of which stores programs readable by a computer, can be applied for the present invention. Further, the programs can be provided to the display control apparatus via communication lines, instead of the ROM 16.

Also, in the above-described embodiment, the programs stored in the ROM 16 are executed directly by the processor 20. However, it is not limited to that, the program can be executed after they are installed in a hard disc from the ROM 16. The programs executable by the computer include programs that can be executed as they are, programs which need to be converted in other formats (for instance decompression of compressed data), and programs executed in combination with other modules.

Further, in the above-described embodiment, the number of active characters are specified as 0 in order not to display characters. However, it is possible to specify other numbers greater than 32 such as 33, 40, 50, 100 etc. in order not to display characters on the display screen.

The present invention is characterized in that a display position is not specified for each character but for each line sprite by specifying the location and the number of characters to be displayed. Less capacity for storing the specification of display position is required. Also, detailed specification can be done for each of the characters. In addition, the operation for the specification can be done easily. Further, since the number of characters to be displayed can be specified for each line, display on the display screen can be changed easily with sufficient flexibility.

Also, the present invention is characterized in that both the background images and the other objects can be displayed in line sprites. The operation for controlling both the background and objects can be done in the same operation. Therefore, it is possible to simplify the circuit and implement easy operation.

Further, the present invention is characterized in that characters are not displayed on the display screen by setting a predetermined number. It is possible to erase or resume line sprites on the display screen easily and quickly (or speedily).

Still further, the present invention is characterized in that the specification means has a size specification means for an image shrink ratio or an image enlargement ratio of all the characters in line sprite units. Enlargement or shrinkage can be done easily in one line units.

The present invention is characterized in that the line specification means has a sequence specification means (chain bit) specifying whether or not its line sprite is displayed sequentially next to the previous line sprite on a display screen. Less operation for specifying display position is demanded as a result of carrying out sequential specification as the sequence specification portion. Therefore display control can be done easily.

Also, the present invention is characterized in that display of the display data for each divided region of a rotating 3-D object is controlled in accordance with the display position data of each of the divided regions being varied according to rotation of the rotating object, and the image size data corresponding to a display position of each of the divided regions.

It is possible to display the rotating object in smooth rotation by preparing a set of display data corresponding to each of the divided regions, and by changing the display position and the image size data with time. It is therefore possible to display a 3-D object such as a sphere in smooth rotation without utilizing a powerful CPU and an extension processor. Also, it is sufficient to prepare a set of display data for each of the divided regions itself. Therefore, it is not necessary to increase capacity of the memory tremendously. In other words, rotating objects such as a sphere can be displayed on the display screen in smooth rotation by utilizing an apparatus at a reasonable price.

Further, the present invention is characterized in that the image size data outputted from the image size data output means are stored in the image size data storing means. Load of the CPU can be reduced by outputting the image size data in accordance with the correspondence table prepared previously which represents a relationship between the display position and the image size data when calculation of the image size data is difficult for the display position of the divided regions. On the other hand, capacity of the memory can be saved by calculating the image size data when the calculation is carried out easily.

The present invention is characterized in that it comprises the following steps: obtaining the display image data corresponding to the divided regions by specifying characters to be displayed, specifying the number of the specified characters, specifying the display positions of the specified characters, and obtaining the image size data of all the specified characters by specifying in line sprite units an image shrink ratio or an image enlargement ratio.

Each of the divided regions is treated as a block of characters. It is therefore possible to carry out specification, enlargement and shrinkage of the display position easily in divided region units. As a result, a rotating 3-D object can be displayed easily. On the other hand, the specification and the change for display can be done in detail in character units. Partial change of the divided regions can be carried out easily. That is, it is possible to change display of a rotating object easily and flexibly.

Also, the present invention is characterized in that it comprises the following steps: obtaining a display pattern corresponding to an image shrink ratio or an enlargement display pattern corresponding to an image enlargement ratio of all the specified characters, and displaying the whole of or part of selected characters on the display screen in accordance with the shrink display pattern or the enlargement display pattern.

Load of the CPU can be reduced by outputting the shrink display pattern in accordance with the correspondence table prepared previously which represents a relationship between the image shrink ratio and the shrink display pattern when there are various shrink display patterns to be outputted in accordance with the image shrink ratio. On the other hand, capacity of the memory can be reduced by outputting the shrink display patterns by the hardware logic when the number of shrink display patterns to be outputted is small.

Further, the present invention is characterized in that the line specification means has a sequence specification portion (chain bit) specifying whether or not its line sprite is displayed sequentially next to the previous line sprite on a display screen. It is not necessary to specify the display position for each of the divided regions. Therefore, even when respective lines positioned adjacently in the storing means have different image shrink ratios, it is possible to display the lines next to each other on the display screen automatically without causing any load to the CPU when the upper edge of the lines are on the same position such as in a cylinder. In other words, it is possible to display rotating objects such as a cylinder easily and speedy.

Still further, the present invention is characterized in that the characters are not displayed on the display screen by setting a predetermined number. It is possible to erase or resume line sprites on the display screen easily and speedy. As a result, both the operation for displaying specific divided regions when the divided regions are visible (the position where the specific divided regions can be seen on the display screen), and for not displaying the divided regions when the specific divided regions are invisible (the position where the specific divided regions can not be seen on the display screen) can be done easily and speedy. In other words, control for displaying a rotating 3-D object can be done easily and quickly (or speedily).

The present invention is characterized in that the line specification means specifies characters for the display of a three-dimensional object and other characters for the display of another object or the background.

The operation for controlling both the background and the objects can be done in the same operation. Therefore, it is possible to simplify the circuit and the operations. As a result, objects can be displayed freely on a rotating 3-D object used as a background. Also, it is possible to display a rotating 3-D object on a background prepared separately from the 3-D object. Further, it is therefore easy to display in combination a background, a rotating 3-D object and other objects simultaneously.

The above description and the accompanying drawings are merely illustrative of the application of the principles of the present invention and are not limiting. Numerous other arrangements which employ the principles of the invention and which fall within its spirit and scope may be readily devised by those skilled in the art. Accordingly, the invention is not limited by the foregoing description, but only limited by the scope of the appended claims.

What is claimed is:

1. A display control apparatus for displaying characters in sprite line units on a display screen by use of the sprite line consisting of a series of the characters, the apparatus comprising:

a character storing part for storing a plurality of different characters, each of the characters having a plurality of pixels provided in both vertical and horizontal directions;

a video RAM with a display specifying part having a plurality of line display specifying parts, each of the line display specifying parts including a first means for individually specifying each of the characters of the series of characters consisting the sprite line, a second means for specifying display positions of the sprite line, and a third means for specifying the number of the characters capable of being displayed form the series of characters consisting the sprite line; and a control means for controlling display of the desired characters on the display screen, the desired characters being selected from the characters stored in the character storing part in accordance with the specifications made by the display specifying part.

2. The display control apparatus in accordance with claim 1, wherein display of a background image is specified with predetermined numbers of the line display specifying parts while display of a sprite image is specified with the line display specifying parts not used for the specification of the background images.

3. The display control apparatus in accordance with claim 1, wherein the sprite line is not displayed on the display screen by setting the number of the characters to be displayed as zero in the third means.

4. The display control apparatus in accordance with claim 1, further comprising a size specification means for specifying in sprite line units an image shrink ratio and an image enlargement ratio in both vertical or horizontal directions.

5. The display control apparatus in accordance with claim 1, wherein the line display specifying parts further include a sequence specification means for specifying whether or not one sprite line specified by one line display specifying part is displayed on the display screen sequentially to another sprite line specified by another line display specifying part.

6. A display control method for displaying characters in sprite line units on a display screen by use of sprite lines consisting of a series of the characters as specified in a video RAM, said characters being stored in a character storing part, the method comprising the steps of:

storing a plurality of different characters in said character storing part, each of the characters for display using a plurality of pixels provided in both vertical and horizontal directions;

in said video RAM, specifying each sprite line by individually specifying the characters of the series of characters consisting each sprite line, specifying display positions of each sprite line, and specifying the number of the characters capable of being displayed from the series of characters consisting each sprite line; and controlling display of desired characters on the display screen, the desired characters being selected from the characters being stored in the character storing part as specified in the video RAM.

7. The display control method in accordance with claim 6, wherein display of a background image is controlled by specifying the sprite lines which at least required for displaying entire background image while display of a sprite image is controlled by specifying the sprite line which required for displaying the sprite image.

* * * * *